US007887648B2

(12) United States Patent
Kinugasa et al.

(10) Patent No.: US 7,887,648 B2
(45) Date of Patent: Feb. 15, 2011

(54) ULTRAHIGH-STRENGTH THIN STEEL SHEET

(75) Inventors: Junichiro Kinugasa, Hyogo (JP); Fumio Yuse, Hyogo (JP); Yoichi Mukai, Hyogo (JP); Shinji Kozuma, Hyogo (JP); Hiroshi Akamizu, Hyogo (JP); Kouji Kasuya, Hyogo (JP); Muneaki Ikeda, Hyogo (JP); Koichi Sugimoto, Nagano (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/159,400

(22) PCT Filed: Dec. 28, 2006

(86) PCT No.: PCT/JP2006/326278

§ 371 (c)(1),
(2), (4) Date: Apr. 24, 2009

(87) PCT Pub. No.: WO2007/077933

PCT Pub. Date: Jul. 12, 2007

(65) Prior Publication Data

US 2009/0238713 A1 Sep. 24, 2009

(30) Foreign Application Priority Data

Dec. 28, 2005 (JP) ..... 2005-379188
Nov. 16, 2006 (JP) ..... 2006-310359
Nov. 16, 2006 (JP) ..... 2006-310458

(51) Int. Cl.
*C22C 38/32* (2006.01)
*C22C 38/28* (2006.01)

(52) U.S. Cl. ..... 148/333; 148/332; 148/330; 148/336

(58) Field of Classification Search ..... 148/320, 148/330–336
See application file for complete search history.

(56) References Cited

U.S. PATENT DOCUMENTS

2005/0150580 A1 7/2005 Akamizu et al.

(Continued)

FOREIGN PATENT DOCUMENTS

EP 0 922 782 A1 6/1999

(Continued)

OTHER PUBLICATIONS

English translation of Japanese patent 2004-190050, Kashima et al., Jul. 8, 2004.*

(Continued)

*Primary Examiner*—Deborah Yee
(74) *Attorney, Agent, or Firm*—Oblon, Spivak, McClelland, Maier & Neustadt, L.L.P.

(57) ABSTRACT

The invention relates to an ultrahigh-strength thin steel sheet excellent in the hydrogen embrittlement resistance, the steel sheet including, by weight %, 0.10 to 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities; in which grains of residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

23 Claims, 5 Drawing Sheets

U.S. PATENT DOCUMENTS

| | | | |
|---|---|---|---|
| 2006/0137768 | A1 | 6/2006 | Yuse et al. |
| 2006/0137769 | A1 | 6/2006 | Yuse et al. |
| 2006/0169366 | A1 | 8/2006 | Yuse et al. |
| 2006/0169367 | A1 | 8/2006 | Yuse et al. |

FOREIGN PATENT DOCUMENTS

| | | | |
|---|---|---|---|
| EP | 0 974 677 | A1 | 1/2000 |
| EP | 0 997 548 | A1 | 5/2000 |
| EP | 1 365 037 | A1 | 11/2003 |
| EP | 1 553 202 | A1 | 7/2005 |
| JP | 11 293383 | | 10/1999 |
| JP | 2003 166035 | | 6/2003 |
| JP | 2004-169180 | | 6/2004 |
| JP | 2004 308002 | | 11/2004 |
| JP | 2004 332099 | | 11/2004 |
| JP | 2005 97725 | | 4/2005 |
| JP | 2005 220440 | | 8/2005 |

OTHER PUBLICATIONS

U.S. Appl. No. 12/610,727, filed Nov. 2, 2009, Ikeda, et al.
Yamada, Toshiro et al., "The Mixed Structure With Bainite and Retained Austenite in a Si-Mn Steel", Nissin Steel Technical Report, No. 43, pp. 1-10 (1980) (with English abstract).
"New Development in Elucidation of Delayed Fracture (Okurehakaikaimei No Shintenkai)", The Iron and Steel Institute of Japan, pp. 111-120 (1997) (with partial English translation).
U.S. Appl. No. 12/477,299, filed Jun. 3, 2009, Ikeda, et al.
U.S. Appl. No. 12/303,566, filed Dec. 5, 2008, Nakaya, et al.
U.S. Appl. No. 12/303,634, filed Dec. 5, 2008, Nakaya, et al.
U.S. Appl. No. 12/305,998, filed Dec. 22, 2008, Saito, et al.
Supplementary European Search Report issued Oct. 4, 2010 in Application No. EP 06843656, filed Dec. 28, 2006.

* cited by examiner

ULTRAHIGH-STRENGTH THIN STEEL SHEET

TECHNICAL FIELD

The invention relates to an ultrahigh-strength thin steel sheet that is used as a steel sheet for automobiles and a steel sheet for transporting machineries, and, in particular, to an ultraultrahigh-strength thin steel sheet where fractures due to the hydrogen embrittlement such as the season cracking and delayed fracture that are problematic in particular in a steel sheet having the tensile strength of 980 MPa or more are inhibited from occurring.

BACKGROUND ART

So far, a high strength steel sheet has been used a lot in applications such as bolts, PC steel wires and line pipes, and, it is known that when the tensile strength becomes 980 MPa or more, due to intrusion of hydrogen into steel, the hydrogen embrittlement (such as the pickling embrittlement, plating embrittlement and delayed fracture) is caused. Compared with this, since a steel sheet thickness is thin, when hydrogen is intruded, hydrogen is released in a short time. Additionally, from the view point of the workability and weldability, since a steel sheet of 780 MPa or more has not been used so much, an aggressive countermeasure to the so-called hydrogen embrittlement has not been considered.

However, recently, from the necessity of attaining light weight in automobiles and of improving the collision safety thereof, there has been a rapidly increasing tendency in applying the press molding or bending work to a ultrahigh-strength steel sheet of 980 MPa or more to use in a reinforcement material such as bumpers or impact beams or a sheet rail. Furthermore, also parts such as pillars to which the press molding or bending work are applied are demanded to be high in the mechanical strength. Accompanying this, a demand for an ultrahigh-strength thin steel sheet provided with the hydrogen embrittlement susceptibility resistance is becoming high.

As a steel sheet responding to such the demand, in particular, a steel sheet that uses TRIP (TRansformation Induced Plasticity) steel is gathering attention.

The TRIP steel is a steel sheet where an austenite texture remains and, when the working deformation is applied, due to the stress, residual austenite (residual $\gamma$) is induced to transform to martensite to enable to obtain large elongation. As the kinds thereof, some may be cited. Examples thereof include a TRIP type composite texture steel (TPF steel) that contains residual austenite with polygonal ferrite as a matrix phase; a TRIP type tempered martensite steel (TAM steel) that contains residual austenite with tempered martensite as a matrix phase; and TRIP type bainitic steel (TBF steel) that contains residual austenite with bainitic ferrite as a matrix phase. Among these, the TBF steel has long been known (described in, for example, non-patent document 1), and has such advantages as that, due to hard bainitic ferrite, high strength is readily obtained, and, in the texture, fine residual austenite grains are easily formed in the boundary of lath-shaped bainitic ferrite and such the texture transformation shows very excellent elongation. Furthermore, the TBF steel also has such an advantage from the production point of view as that it can be easily manufactured by a single heat treatment process (continuous annealing process or plating process).

When the hydrogen embrittlement resistance (hydrogen embrittlement resistance properties) of the TRIP steel are improved, it is considered to convert the technology relating to bar steel and bolt steel where various kinds of elements are added to a steel. For instance, in non-patent document 2, it is reported that, when in a metallographic texture formed mainly of tempered martensite, additive elements such as Cr, Mo and V that show the resistance to temper softening are added, the delayed fracture resistance is effectively improved. This is a technology where alloy carbide is precipitated in a steel to utilize as a hydrogen trap site and thereby the delayed fracture form is converted from the intergranular fracture to the transgranular fracture. Furthermore, in patent document 1, it is reported that an oxide mainly made of Ti and Mg effectively inhibits the hydrogen-related defect from occurring. Furthermore, in patent document 2, it is reported that when a dispersion state of oxide and sulfide of Mg, composite precipitated or precipitated compound is controlled and residual austenite in a microstructure of a steel sheet and the mechanical strength of the steel sheet are controlled, the elongation (ductility) and the delayed fracture resistance after the working are made compatible.

Patent document 1: JP-A-11-293383

Patent document 2: JP-A-2003-166035

Non-patent document 1: NISSIN STEEL TECHNICAL REPORT, No. 43, December 1980, pp 1-10

Non-patent document 2: "New Development in Elucidation of Delayed Fracture (Okurehakaikaimei no shintenkai)" (published by The Iron and Steel Institute of Japan in January, 1997, pp 111-120)

DISCLOSURE OF THE INVENTION

However, in the technologies of non-patent documents 1 and 2, since the steel contains 0.4% by weight or more of C and many alloy elements, the workability and weldability required in the thin steel sheet are very poor, and, furthermore, since a precipitation heat treatment necessarily takes several hours or more to precipitate alloy carbide, the productivity as well is problematic.

The technology of patent document 1 is aimed at a thick steel sheet and the delayed fracture particularly after high heat input welding is considered. However, a usage environment in automobile parts made of a thin steel sheet is not sufficiently considered. Furthermore, in the technology of patent document 2, under such an environment where corrosion is actually generated and hydrogen is present, the trapping effect of the precipitates alone is not sufficient.

Still furthermore, when Cr is added, coarse inclusions (carbide) are generated in the TRIP steel (particularly in the neighborhood of the grain boundary), very hard cementite that causes crack during the processing is much precipitated, and the residual austenite is inhibited from generating. From these reasons, Cr has not been added to the TRIP steel. Furthermore, when the coarse inclusions (carbide) are present in the neighborhood of the grain boundary, not only the mechanical strength and elongation of the steel sheet are deteriorated, but also hydrogen intruded from the environment is accumulated in the periphery of the coarse inclusion to deteriorate the hydrogen embrittlement resistance.

As mentioned above, the technology of the bar steel and bolt steel has not been able to improve the hydrogen embrittlement resistance of the TRIP steel. Furthermore, there are hardly found examples of development where, while excellent workability that is a feature of the TRIP steel sheet is exerted, a severe usage environment that covers a long time like in automobile parts is sufficiently considered and a countermeasure to the hydrogen embrittlement after the working is applied.

The invention was carried out in view of the foregoing situations and intends to provide a TRIP type ultrahigh-strength thin steel sheet where, without damaging excellent ductility (elongation) that is a feature of the TRIP steel sheet, in an ultrahigh-strength region in which the tensile strength is 980 MPa or more, the hydrogen embrittlement resistance is remarkably enhanced.

Furthermore, the invention further intends to provide a TRIP type ultrahigh-strength thin steel sheet having the tensile strength of 980 MPa or more, in which a steel sheet, after molding into parts, exerts excellent hydrogen embrittlement resistance under severe usage conditions over a long time and the workability is further improved.

Still furthermore, the invention intends to provide a TRIP type ultrahigh-strength thin steel sheet having the tensile strength of 980 MPa or more, in which, even when Cr is added, different from the conventional technology, coarse carbide is not generated in the neighborhood of the grain boundary and the hydrogen embrittlement resistance is drastically improved.

Namely, the invention relates to an ultrahigh-strength thin steel sheet excellent in the hydrogen embrittlement resistance, the steel sheet including, by weight %, 0.10 to 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities, in which grains of residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

According to an ultrahigh-strength thin steel sheet according to a first embodiment of the invention shown below, when a component composition and the residual austenite in the steel sheet are controlled, with neither damaging the ductility (elongation) nor generating coarse carbide in the neighborhood of the grain boundary, the hydrogen embrittlement resistance is remarkably enhanced in an ultrahigh-strength region where the tensile strength is 980 MPa or more. Furthermore, when a content of Mo is reduced and B is added, the corrosion resistance after coating is improved.

Furthermore, a ultrahigh-strength thin steel sheet excellent in the hydrogen embrittlement resistance is produced at excellent productivity and may be used, as a ultrahigh-strength part that is very difficult to cause the delayed fracture and so on, in automobile parts such as reinforcement materials such as a bumper and an impact beam, a seat rail, a pillar, a reinforcement and a member.

According to an ultrahigh-strength thin steel sheet according to a second embodiment of the invention shown below, when a component composition and residual austenite of a steel sheet are controlled, with neither damaging the ductility (elongation) nor generating coarse carbide in the neighborhood of the grain boundary, the hydrogen embrittlement resistance is remarkably enhanced in an ultrahigh-strength region where the tensile strength is 980 MPa or more. Furthermore, when a content of Mo is reduced and B is added, the corrosion resistance after coating is improved.

Furthermore, an ultrahigh-strength thin steel sheet excellent in the hydrogen embrittlement resistance is produced at excellent productivity and may be used, as an ultrahigh-strength part that is very difficult to cause the delayed fracture and so on, in automobile parts such as reinforcement materials such as a bumper and an impact beam, a seat rail, a pillar, a reinforcement and a member.

DESCRIPTION OF REFERENCE NUMERALS AND SIGNS

Figure 1:
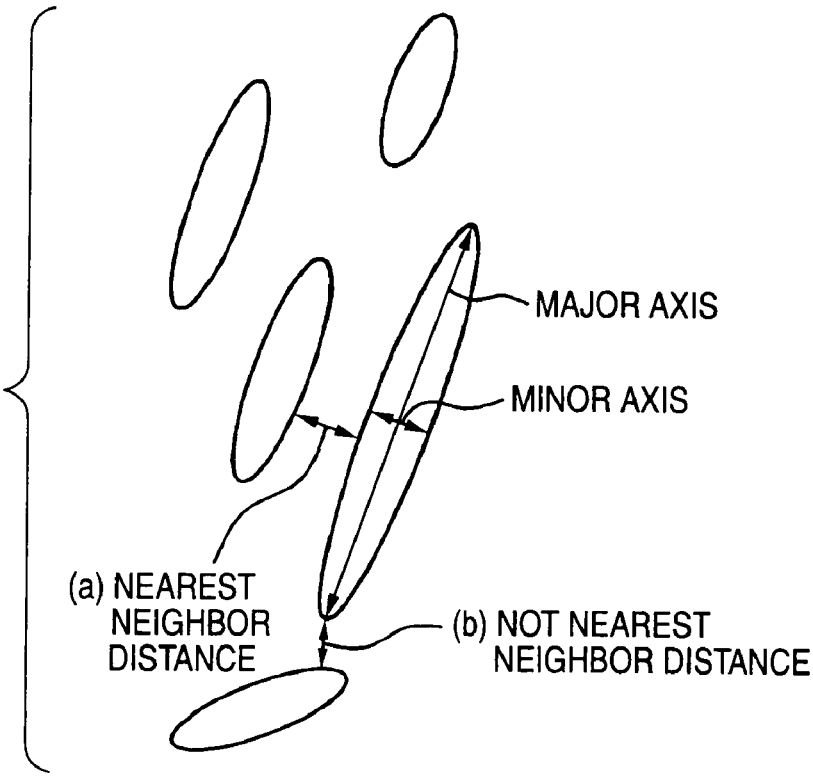
FIG. 1 is a diagram schematically showing the grains of the residual austenite in a first embodiment of the invention.

1: Part for Crush Resistance Test (Test Piece)
2, 5: Position of Spot Welding
3: Mold
4: Part for Impact Resistance Test (Test Piece)
6: Falling Weight
7: Table (for Impact Resistance Test)

BEST MODE FOR CARRYING OUT THE INVENTION

In what follows, the invention will be described in detail below.

As one of preferable embodiments of the invention, (1) shown below may be mentioned (hereinafter, in some cases, simply referred to as a first embodiment of the invention).

(1) An ultrahigh-strength thin steel sheet excellent in hydrogen embrittlement resistance, the steel sheet including, by weight %, 0.10 to 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities;

in which grains of residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

Here, an ultrahigh-strength thin steel sheet excellent in the hydrogen embrittlement resistance according to a first embodiment of the invention contains, by weight %, 0.10 to 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities; in which grains of residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

When the ultrahigh-strength thin steel sheet of the first embodiment of the invention is thus configured, since predetermined amounts of C, Si, Mn, P, Al and Cr are contained, the mechanical strength of the steel sheet is enhanced and the residual austenite is effectively generated in the steel sheet. When the area ratio and the dispersion state (average axis ratio, average minor axis length, a nearest-neighbor distance) of the residual austenite are stipulated, not aggregate but fine lath-shaped residual austenite is dispersed in the steel. Since the fine lath-shaped austenite exerts the hydrogen trap capability overwhelmingly larger than that of carbide in the steel sheet, hydrogen intruding owing to the atmospheric corrosion is rendered practically harmless. Furthermore, in particular, when a predetermined amount of Cr is contained, coarse carbide does not precipitate in the steel sheet and fine carbide is dispersed, resulting in enhancing the hydrogen trap capability and inhibiting the crack from propagating.

The ultrahigh-strength thin steel sheet of the first embodiment of the invention preferably contains, in terms of an area ratio with respect to a total texture of the steel sheet, bainitic ferrite and martensite in a total amount of 80% or more and ferrite and pearlite in a total amount of 0 to 9%.

When the ultrahigh-strength thin steel sheet of the first embodiment of the invention is thus configured, since a matrix of the steel sheet is constituted of bainitic ferrite and martensite, the mechanical strength of the steel sheet is further improved and a starting point of the intergranular fracture is eliminated.

In the ultrahigh-strength thin steel sheet of the first embodiment of the invention, the steel sheet preferably further contains, by weight %, at least one of 0.003 to 0.5% of Cu and 0.003 to 1.0% of Ni.

When the ultrahigh-strength thin steel sheet of the first embodiment of the invention is thus configured, since, owing to the inclusion of predetermined amounts of Cu and Ni, thermodynamically stable protective rust is promoted to generate, even under a severe corrosive environment, the hydrogen-assisted crack and the like are sufficiently inhibited from occurring to improve the corrosion resistance, resulting in further improving the hydrogen embrittlement resistance.

In the ultrahigh-strength thin steel sheet according to the first embodiment of the invention, the steel sheet preferably further contains, by weight %, at least one of Ti, V, Zr and W in a total amount of 0.003 to 1.0%.

When the ultrahigh-strength thin steel sheet of the first embodiment of the invention is thus configured, since a predetermined amount of at least onr of Ti, V, Zr and W is contained, the mechanical strength of the steel sheet is further improved. Furthermore, the texture of the steel sheet is finely particulated, resulting in further improving the hydrogen trapping capacity. Furthermore, thermodynamically stable protective rust is promoted to generate to improve the corrosion resistance, resulting in further improving the hydrogen embrittlement resistance.

In the ultrahigh-strength thin steel sheet according to the first embodiment of the invention, the steel sheet preferably further contains, by weight %, at least one of 1.0% or less of Mo and 0.1% or less of Nb.

When the ultrahigh-strength thin steel sheet of the first embodiment of the invention is thus configured, since predetermined amounts of Mo and Nb are contained, the mechanical strength of the steel sheet is further improved. Furthermore, since the texture of the steel sheet is finely particulated and the residual austenite is more effectively generated, the hydrogen trapping capability is further improved.

In the ultrahigh-strength thin steel sheet according to the first embodiment of the invention, the steel sheet preferably further contains, by weight %, at least one of 0.2% or less of Mo and 0.1% or less of Nb.

When the ultrahigh-strength thin steel sheet of the first embodiment of the invention is thus configured, since predetermined amounts of Mo and Nb are contained, a prior-to coating treatment is uniformized and the coating adhesiveness is improved.

In the ultrahigh-strength thin steel sheet according to the first embodiment of the invention, the steel sheet preferably further contains, by weight %, 0.0002 to 0.01% of B.

When the ultrahigh-strength thin steel sheet of the first embodiment of the invention is thus configured, since a predetermined amount of B is contained, the mechanical strength of the steel sheet is further improved and, owing to the concentration of B in a grain boundary, the grain boundary cracking is inhibited from occurring.

In the ultrahigh-strength thin steel sheet according to the first embodiment of the invention, the steel sheet preferably further contains, by weight %, 0.0005 to 0.01% of B.

When the ultrahigh-strength thin steel sheet of the first embodiment of the invention is thus configured, since a predetermined amount of B is contained, a prior-to coating treatment is uniformized and the coating adhesiveness is improved. Furthermore, the strength deficiency due to a decrease in Mo may be supplemented.

In the ultrahigh-strength thin steel sheet according to the first embodiment of the invention, the steel sheet preferably further contains, by weight %, at least one kind selected from the group consisting of 0.0005 to 0.005% of Ca, 0.0005 to 0.01% of Mg and 0.0005 to 0.01% of REM.

When the ultrahigh-strength thin steel sheet of the first embodiment of the invention is thus configured, since predetermined amounts of at least one of Ca, Mg and REM is contained, since a hydrogen ion concentration in an interface environment resulting from corrosion of a steel sheet surface is inhibited from going up, the corrosion resistance is improved, resulting in further improving the hydrogen embrittlement resistance.

In what follows, the first embodiment of the invention will be described in detail below.

In the case of tempered martensite steel or a combination of martensite and ferrite steel, which have been generally adopted as a high strength steel material, the hydrogen-induced delayed fracture is considered caused in such a manner that hydrogen is accumulated in a prior austenite grain boundary to form a void and the portion works as a starting point of the hydrogen-induced delayed fracture. Accordingly, in order to lower the susceptibility of the delayed fracture, it has been considered general resolving means to uniformly and finely disperse trap sites of hydrogen such as carbide to trap hydrogen there to lower a concentration of diffusive hydrogen. However, even when the trap sites of hydrogen such as carbide are dispersed a lot, since there is a limit in the trapping capability, the hydrogen-induced delayed fracture is not sufficiently inhibited.

Furthermore, when coarse inclusions are present in steel (in the neighborhood of the grain boundary, in particular), it is considered that the stress due to deformation is concentrated on the inclusions to promote the cracking. In order to inhibit this from occurring, it is preferred that a texture is contrived so as not to contain the coarse inclusions in the steel to avoid the stress concentration.

In this connection, in order to achieve higher grade hydrogen embrittlement resistance (delayed fracture resistance) that sufficiently considers a usage environment in an ultrahigh-strength thin steel sheet (hereinafter, referred to as steel sheet), with paying attention to detoxification of hydrogen (intensification of hydrogen trapping capacity), the inventors studied specific means thereof.

As a result, it was found effective to form residual austenite which is very high in the hydrogen trapping capability and the hydrogen storage capability. However, when the residual austenite which is very high in the hydrogen storage capacity is present as a coarse aggregate, voids tend to be formed to form starting points of fracture under the stress load. In order that the residual austenite, while sufficiently exerting the hydrogen trapping action, may not be starting points of fracture, a form of the residual austenite has to be controlled in a fine lath-shape. The residual austenite in a general TRIP steel is formed in aggregates of micrometer order. However, in the first embodiment of the invention, the residual austenite is formed a sub-micrometer order and has a fine lath-shape.

Furthermore, it is found that when 1% or more of residual austenite is contained in terms of an area ratio with respect to a total texture of the steel sheet and the residual austenite is present dispersed in the steel sheet so that a dispersion form may satisfy that an average axis ratio (major axis/minor axis) of the grains of the residual austenite is 5 or more, an average minor axis length of grains of the residual austenite is 1 μm or less and the nearest-neighbor distance between the grains of the residual austenite is 1 μm or less, without adding a particular alloy element, the hydrogen embrittlement resistance (delayed fracture properties, assisted cracking resistance and the like) in a steel sheet is sufficiently enhanced, thereby, achieving the first embodiment of the invention. In what follows, an area ratio and a dispersion form of the residual austenite according to the first embodiment of the invention will be described.

<Residual Austenite Being 1% or More in Terms of an Area Ratio>

From the viewpoints of securing the hydrogen absorption capability of the residual austenite and the elongation of the steel sheet, in the first embodiment of the invention, in terms of the area ratio with respect to a total texture of the steel sheet, the residual austenite is necessarily present 1% or more. The area ratio is preferably 2% or more and more preferably 3% or more. When the residual austenite is present 15% or more, a problem in that the mechanical strength becomes difficult to secure is caused; accordingly, the upper limit thereof is preferably set at 15%. The area ratio is preferably set at 14% or less and more preferably at 13% or less.

Furthermore, from the viewpoint of the stability of the residual austenite, a C concentration ($C_{\gamma R}$) in the residual austenite is recommended to be 0.8% by weight or more. When the $C_{\gamma R}$ is controlled to 0.8% by weight or more, the elongation and so on may be effectively enhanced. The $C_{\gamma R}$ is preferably 1.0% by weight or more and more preferably 1.2% by weight or more. The higher the $C_{\gamma R}$ is, the more preferable. However, from the viewpoint of actual operation, practically controllable upper limit is considered substantially 1.6% by weight.

<Average Axis Ratio (Major Axis/Minor Axis) of the Grains of the Residual Austenite Being 5 or More>

Figure 2:
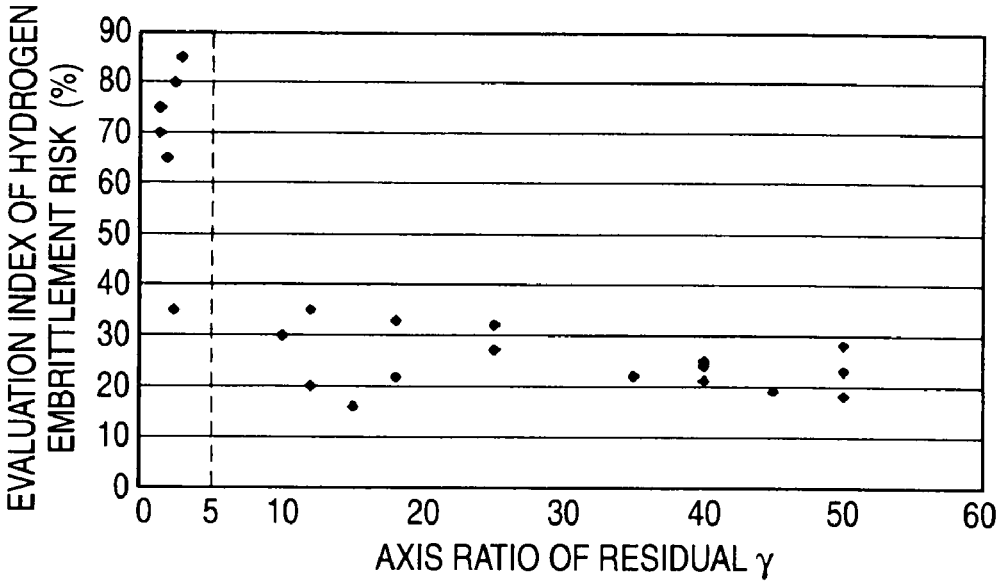
FIG. 2 is a graph showing relationship between an average axis ratio of the grains of the residual austenite and an evaluation index of the hydrogen embrittlement risk in a first embodiment of the invention.

FIG. 2 is a graph showing, in the first embodiment of the invention, relationship between an average axis ratio (residual γ axis ratio in FIG. 2) of the grains of the residual austenite measured by a method described below and an evaluation index of hydrogen embrittlement risk (measured by a method shown in a following example and means that the smaller the numerical value is, the more excellent the hydrogen embrittlement resistance is).

From FIG. 2, it is found that in particular when the average axis ratio of the grains of the residual austenite is 5 or more, the evaluation index of the hydrogen embrittlement risk rapidly decreases. This is considered because, when the average axis ratio of the grains of the residual austenite becomes such high as 5 or more, the hydrogen absorption capability that the residual austenite intrinsically has is sufficiently exerted, the hydrogen trapping capacity becomes far larger than that of carbide, hydrogen that intrudes due to so-called atmospheric corrosion is practically detoxified, whereby a remarkable improvement in the hydrogen embrittlement resistance is exerted.

On the other hand, the upper limit of the average axis ratio is not specified particularly from the viewpoint of enhancing the hydrogen embrittlement resistance. However, in order to make the TRIP effect exert effectively, a thickness of the residual austenite is necessary to a certain extent. Accordingly, the upper limit is preferably set at 30 and more preferably set at 20 or less.

<Average Minor Axis Length of the Grains of the Residual Austenite Being 1 μm or Less>

FIG. 1 is a diagram schematically showing the grains of (lath-shaped) residual austenite. It is found that, as shown in FIG. 1, when the grains of the residual austenite, which have the average minor axis length of 1 μm or less, are dispersed, the hydrogen embrittlement resistance is improved. This is considered because, when fine residual austenite grains having a short average minor axis length are dispersed a lot, a surface area of the residual austenite becomes larger to increase the hydrogen trapping capacity.

Furthermore, the average minor axis length is preferably 0.5 μm or less and more preferably 0.25 μm or less.

<The Nearest-Neighbor Distance Between the Grains of the Residual Austenite Being 1 μm or Less>

As shown in FIG. 1, it was found that, when the nearest-neighbor distance between the grains of the residual austenite is controlled, the hydrogen embrittlement resistance is more enhanced. This is considered because, when fine lath-shaped residual austenite grains are finely dispersed, the fracture is inhibited from propagating.

Furthermore, the nearest-neighbor distance is preferably 0.8 μm or less and more preferably 0.5 μm or less.

The residual austenite means a region that is observed as a FCC (face-centered cubic lattice) by use of a FE-SEM (Field Emission type Scanning Electron Microscope) provided with an EBSP (Electron Back Scatter diffraction Pattern) detector. In the EBSP, an electron beam is inputted on a sample surface, and a Kikuchi pattern obtained from reflected electrons generated at this time is analyzed to determine a crystal orientation at an electron incident position. When an electron beam is scanned two-dimensionally on a sample surface and a crystal orientation is measured every determined pitch, an orientation distribution on a sample surface is measured.

An example of measurement will be cited. At a position one fourth a sheet thickness, an arbitrary measurement area (substantially 50 μm×50 μm, measurement distance: 0.1 μm) in a plane in parallel with a rolled plane is taken as a target of measurement. When the polishing is applied to the measurement plane, in order to inhibit the residual austenite from transforming, electrolytic polishing is applied. In the next place, by use of the "FE-SEM provided with EBSP", an EBSP image is taken with a high-sensitivity camera and taken in as an image in a computer. An image analysis is carried out and a FCC phase determined by comparing with a pattern owing to simulation with a known crystal system (FCC (face-centered cubic lattice) in the case of residual austenite) is color-mapped. Thus, an area ratio of the mapped region is obtained and this is taken as the area ratio of the residual austenite texture. As hard ware and soft ware according to the above-mentioned analysis, an OIM (Orientation Imaging Microscopy™) system (available from TexSEM Laboratories Inc.) may be used.

Measurement methods of the average axis ratio, average minor axis length and nearest-neighbor distance of the grains of the residual austenite are as shown below. In the beginning, the average axis ratio of the grains of the residual austenite is obtained in such a manner that a TEM is used to observe (multiplying factor: 15,000 times, for instance), major axes and minor axes (see FIG. 1) of the grains of the residual austenite present in arbitrarily selected three viewing fields are measured to obtain axis ratios, and an average value thereof is calculated as an average axis ratio. The average minor axis length of grains of the residual austenite is obtained by calculating an average value of minor axes measured as mentioned above. The nearest-neighbor distance between the grains of the residual austenite is obtained in such a manner that a TEM is used to observe (multiplying factor: 15,000 time, for instance), in arbitrarily selected three viewing fields, distances between the grains of the residual austenite arranged in a major axis direction, which are shown as (a) in FIG. 1, are measured, the minimum value thereof is taken as the nearest-neighbor distance, and the nearest-neighbor distances of three viewing fields are averaged to obtain the nearest-neighbor distance. A distance such as (b) shown in FIG. 1 is not taken as the nearest-neighbor distance.

In order to further improve the hydrogen embrittlement resistance (delayed fracture property) of the steel sheet the inventors studied specific means thereof, with paying attention to eliminate starting points of the intergranular fracture.

As a result, it is found effective to form a matrix phase of a steel sheet into not a single phase texture of martensite but a two phase texture of ferrite and martensite. In martensite, carbide such as film-like cementite or the like precipitates to be likely to cause the intergranular fracture. On the other hand, bainitic ferrite that is, different from general (polygonal) ferrite, planar ferrite, high in the dislocation density, high in the mechanical strength of a whole texture, free from carbide that becomes a starting point of the intergranular fracture and high in the hydrogen trapping capacity; accordingly, bainitic ferrite is most preferable as a matrix phase of a steel sheet.

In the first embodiment of the invention, in order to effectively exert the hydrogen trapping capacity like this, in terms of an area ratio with respect to a total texture of a steel sheet, bainitic ferrite and martensite are contained, in total, preferably 80% or more and more preferably 85% or more. On the other hand, the upper limit thereof is determined from a balance with other texture (residual austenite), and, when a ferrite texture is not contained, the upper limit is controlled to 99%.

A steel sheet of the first embodiment of the invention may be formed of only the foregoing texture (that is, a mixed texture of bainitic ferrite and martensite with the residual austenite). However, within a range that does not damage an action of the invention, as other texture, polygonal ferrite or pearlite may be contained. Although these are textures that inevitably remain in a producing process of the invention, the slighter is the more preferable. In the first embodiment of the invention, the area ratio to a total texture is suppressed to 9% or less, preferably to less than 5% and more preferably to less than 3%.

The bainitic ferrite in the invention is planar ferrite and means a lower texture high in the dislocation density. On the other hand, polygonal ferrite or pearlite is free from dislocation or has a lower texture extremely less in the dislocation, has a polygonal shape and does not contain the residual austenite or martensite inside thereof.

The area ratios of (bainitic ferrite and martensite) and (polygonal ferrite and pearlite) are obtained as shown below. That is, a steel sheet is corroded with nital, an arbitrary measurement area (substantially 50×50 μm) in a plane in parallel with a rolled plane is observed at a position one fourth a sheet thickness by use of the FE-SEM (multiplying factor: 1500 times), the color adjustment is applied to discern the textures, and the area ratios are calculated. The bainitic ferrite and martensite show up deep gray color in the SEM photograph (in the case of SEM, in some cases, bainitic ferrite and the residual austenite or martensite are not separated and differentiated); however, since polygonal ferrite and pearlite are shown black in the SEM photograph, these are clearly discerned.

The invention is, as mentioned above, characterized in that the area ratio and the dispersion form of the residual austenite are controlled. However, in order to control the area ratio of the residual austenite and the dispersion form thereof and to obtain a steel sheet that exerts stipulated mechanical strength, a component composition has to be controlled as shown below.

<C: 0.10 to 0.25% by Weight>

Now, C is an element that enables to raise the mechanical strength of a steel sheet. In the first embodiment of the invention, C is an element indispensable in particular for securing the residual austenite and 0.10% by weight or more of C is necessary to obtain the mechanical strength of 980 MPa or more. The content of C is preferably 0.12% by weight or more and more preferably 0.15% by weight or more. However, from the viewpoint of securing the corrosion resistance and weldability, in the first embodiment of the invention, an amount of C is set at 0.25% by weight or less and preferably at 0.23% by weight or less.

<Si: 1.0 to 3.0% by Weight>

Then, Si is an element important for effectively inhibiting the residual austenite from decomposing to generate carbide and a substitutional solid-solution hardening element that largely hardens a material. In order to effectively exert such an advantage, Si is necessarily contained 1.0% by weight or more (preferably 1.2% by weight or more and more preferably 1.5% by weight or more). However, when Si is contained exceeding 3.0% by weight, a scale is remarkably formed during the hot rolling and it costs much to remove the flaw to be economically disadvantageous; accordingly, the upper limit is set at 3.0% by weight (preferably 2.5% by weight or less and more preferably 2.0% by weight or less).

<Mn: 1.0 to 3.5% by Weight>

An element of Mn is necessary to stabilize austenite and to obtain desired residual austenite and is necessarily contained 1.0% by weight or more (preferably 1.2% by weight or more and more preferably 1.5% by weight or more). On the other hand, when Mn is contained much, the segregation becomes remarkable to, in some cases, deteriorate the workability; accordingly, the upper limit is set at 3.5% by weight (preferably at 3.0% by weight).

<P: 0.15% by weight or Less (not Including 0% by Weight)>

An element of P is an element that helps cause the intergranular fracture due to the grain boundary segregation and is preferable to be contained less; accordingly, the upper limit is set at 0.15% by weight, preferably at 0.10% by weight or less and more preferably at 0.05% by weight or less.

<S: 0.02% by Weight or Less (Not Including 0% by Weight)>

An element of S is an element that helps absorb hydrogen under a corrosive environment and is preferably contained less; accordingly, the upper limit is set at 0.02% by weight.

<Al: 1.5% by Weight or Less (Not Including 0% by Weight)>

An element of Al may be added 0.01% by weight or more to deoxidize. It has an advantage of inhibiting hydrogen from intruding into steel and a content thereof is preferably set at 0.02% by weight or more (preferably at 0.2% by weight or more and more preferably at 0.5% by weight or more). Furthermore, Al not only deoxidizes but also works so as to improve the corrosion resistance and hydrogen embrittlement resistance. It is considered that, when Al is added, the corrosion resistance is improved to result in decreasing an amount of hydrogen generated owing to the atmospheric corrosion, and, as a result thereof, the hydrogen embrittlement resistance as well is improved. Still furthermore, it is considered that, when Al is added, the lath-like residual austenite is further stabilized to contribute to improve the hydrogen embrittlement resistance. However, when an addition amount of Al is increased, inclusions such as alumina and so on are increased to deteriorate the workability; accordingly, the upper limit is set at 1.5% by weight.

<Cr: 0.003 to 2.0% by Weight>

An element of Cr is very effective when it is contained in the range of 0.003 to 2.0% by weight. It is considered that, when Cr is added, the hardenability is improved to enable to readily secure the mechanical strength of the steel sheet and the corrosion resistance is improved to reduce an amount of hydrogen generated owing to the atmospheric corrosion to result in improving the hydrogen embrittlement resistance. Furthermore, in the invention, it is found that, by studying heat treatment conditions and so on, even when Cr is added, fine carbide is dispersed in the steel without precipitating coarse carbide in the steel. Additionally it is also found that, by studying a composition range, the residual austenite is effectively generated. Whereby, it is considered that addition of Cr contributes to improve the hydrogen trapping capability and to inhibit the cracking from propagating. The advantage is more effectively exerted when Cu and Ni described below are used together.

In order to exert the advantages, the lower limit value of the addition amount is necessarily set at 0.003% by weight or more (preferably at 0.1% by weight or more and more preferably at 0.3% by weight or more). Furthermore, when Cr is added excessively, the advantages saturate and the workability is deteriorated; accordingly, the upper limit value is set at 2.0% by weight (preferably at 1.5% by weight or less and more preferably at 1.0% by weight or less). Still furthermore, Cr has an adverse effect of promoting the under film corrosion. Accordingly, in order to improve the corrosion resistance after coating, Cr is added as small as possible in the above range.

A component composition stipulated in the invention is as follows. That is, a balance component is substantially made of Fe, as inevitable impurities incorporated in the steel owing to raw materials, materials, producing equipment and so on, 0.001% by weight or less of N and so on is contained, and, to an extent that does not adversely affect on the advantages of the invention, elements below may be positively contained.

<Cu: 0.003 to 0.5% by Weight and/or Ni: 0.003 to 1.0% by Weight>

It is very effective to contain Cu: 0.003 to 0.5% by weight and/or Ni: 0.003 to 1.0% by weight. In more detail, when Cu and/or Ni is/are present, the corrosion resistance of the steel sheet per se is improved; accordingly, hydrogen is sufficiently inhibited from generating owing to the corrosion of the steel sheet. Furthermore, the elements have an advantage in promoting formation of iron oxide: α-FeOOH that is mentioned to be thermodynamically stable and have the protective property among rust generated in air. Accordingly, when the generation of the rust is promoted and, thereby, the generated hydrogen is inhibited from intruding into the steel sheet, under a severe corrosive environment, the hydrogen-assisted fracture is sufficiently inhibited from occurring. In order to exert the advantages, when Cu and/or Ni is/are contained, the respective contents are set necessarily at 0.003% by weight or more, preferably at 0.05% by weight or more and more preferably at 0.1% by weight or more. Furthermore, when any one of the both is contained excessively, the workability is deteriorated; accordingly, the upper limits are set respectively at 0.5% by weight and 1.0% by weight.

<Ti, V, Zr, W: 0.003 to 1.0% by Weight in Total>

An element of Ti has the generation promoting effect of the protective rust similarly to Cu, Ni and Cr. The protective rust has a very useful advantage in that β-FeOOH that is generated in particular under a chloride environment to adversely affect on the corrosion resistance (resultantly the hydrogen embrittlement resistance) is inhibited from generating. The generation of such the protective rust is promoted when, in particularly, Ti and V (or Zr, W) are added in combination. An element of Ti is an element that imparts very excellent corrosion resistance and has as well an advantage of cleaning the steel.

Furthermore, V is an element that is effective, in addition to having, as mentioned above, an advantage of improving the hydrogen embrittlement resistance in a combination with Ti, in improving the mechanical strength of the steel sheet and finely particulating and, when a shape of carbide is controlled, in playing a function effective as hydrogen trap. That is, V is, in combination with Ti and Zr, effective in improving the hydrogen embrittlement resistance.

An element of Zr is an element effective in improving the mechanical strength of the steel sheet and finely particulating and coexists with Ti to improve the hydrogen embrittlement resistance.

An element of W is effective in improving the mechanical strength of the steel sheet and a precipitate thereof is effective as a hydrogen trap as well. Furthermore, generated rust rejects a chloride ion to contribute to improve the corrosion resistance as well. In combination with Ti and Zr, the corrosion resistance and hydrogen embrittlement resistance are effectively improved.

In order to sufficiently exert the advantages of Ti, V, Zr and W, these are necessarily contained 0.003% by weight or more in total (preferably 0.01% by weight or more). When these are added excessively, carbide is precipitated much to result in deteriorating the workability. Accordingly, these are necessarily added in the range of 1.0% by weight or less in total and preferably 0.5% by weight or less.

<Mo: 1.0% by Weight or Less (not Including 0% by Weight)>

An element of Mo is an element necessary for stabilizing austenite and obtaining desired residual austenite. The element is effective not only in inhibiting hydrogen from intruding to improve the delayed fracture properties and enhancing the hardenability of the steel sheet but also in strengthening the grain boundary to inhibit the hydrogen embrittlement from occurring. However, when an addition amount thereof exceeds 1.0% by weight, these advantages saturate; accordingly, the upper limit value is set at 1.0% by weight, preferably at 0.8% by weight or less and more preferably at 0.5% by weight or less.

Furthermore, when Mo is added exceeding a specified amount, a prior-to coating treatment is made non-uniform to deteriorate the corrosion resistance after coating. In addition, a problem in production such that the mechanical strength of the hot-rolled material becomes very high to be difficult to roll is exposed. Furthermore, Mo is very expensive element to be economically disadvantageous from the viewpoint of cost. From the viewpoints, when the corrosion resistance after coating as well is expected, Mo is necessarily added 0.2% by weight or less, preferably 0.03% by weight or less and more preferably 0.005% by weight or less.

<Nb: 0.1% by Weight or Less (Not Including 0% by Weight)>

An element of Nb is an element very effective in improving the mechanical strength of the steel sheet and in finely particulating. In particular, when Nb is used together with Mo, an advantage is exerted. However, when it is added more than 0.1% by weight, the moldability is deteriorated; accordingly, the upper limit value is set at 0.1% by weight and preferably set at 0.08% by weight or less. Furthermore, the lower limit value is not set. However, it is added preferably 0.005% by weight or more and more preferably 0.01% by weight or more.

<B: 0.0002 to 0.01% by Weight>

An element of B is an element effective in improving the mechanical strength of the steel sheet. In the first embodiment of the invention, in order to exert the advantage, B is necessarily contained 0.0002% by weight or more (preferably 0.0005% by weight or more). This is because when B is contained less than 0.0002% by weight, the advantage is not obtained; accordingly, the lower limit value is set at 0.0002% by weight. On the other hand, when B is contained exceeding 0.01% by weight, the hot workability is deteriorated; accordingly, the upper limit value is set at 0.01% by weight and more preferably at 0.005% by weight or less.

Furthermore, in the first embodiment of the invention, when Mo is reduced to improve the corrosion resistance after coating of the steel sheet, the strength deficiency due to a decrease in an amount of Mo is necessarily compensated by adding B. In order to improve the mechanical strength, B is necessarily contained 0.0005% by weight or more (preferably 0.0008% by weight or more and more preferably 0.0015% by weight or more). Furthermore, B homogenizes a prior-to coating treatment such as a phosphate treatment to improve the coating adhesiveness (corrosion resistance after coating). Though a mechanism is unknown, when Ti is added 0.01% by weight or more in the steel, the advantage is more exerted. Furthermore, it is more preferred to contain 0.03% by weight or more of Ti and 0.0005% by weight or more of B. Still furthermore, B has an advantage of strengthening the grain boundary to improve the delayed fracture resistance.

<At Least One Kind Selected from the Group Consisting of Ca: 0.0005 to 0.005% by Weight, Mg: 0.0005 to 0.01% by Weight and REM: 0.0005 to 0.01% by Weight>

These elements are effective in suppressing a rise of a hydrogen ion concentration of an interface environment accompanying corrosion of a steel surface, that is, in suppressing the pH from decreasing. Furthermore, these control a form of a sulfide in the steel to be effective in improving the workability. However, when each of these is contained less than 0.0005% by weight, the advantage is not obtained; accordingly, the lower limit value thereof is set at 0.0005% by weight. Furthermore, when these are contained excessively, the workability is deteriorated; accordingly, the upper limit values, respectively, are set at 0.005% by weight, 0.01% by weight and 0.01% by weight.

The invention does not specify to the producing conditions. However, in order to form the above-mentioned texture that is ultrahigh in the mechanical strength and exerts excellent hydrogen embrittlement resistance from the steel sheet that satisfies the component composition, it is recommended to set a finishing temperature in the hot rolling at a temperature that is in a supercooled austenite region that does not generate ferrite and as low as possible. When the finishing rolling is applied at the temperature, austenite of a hot rolled steel sheet is finely particulated, resulting in a fine texture of an end product.

Furthermore, it is recommended to apply heat treatment according to a procedure shown below after the hot rolling or the cold rolling following the hot rolling.

That is, it is recommended that the steel that satisfies the foregoing component composition is heated and held at a heating and holding temperature (T1) in the range of a $Ac_3$ point (a temperature where a ferrite-austenite transformation comes to completion) to ($Ac_3$ point+50° C.) for 10 to 1800 sec (t1), followed by cooling to a heating and holding temperature (T2) in the range of (Ms point (a martensite transformation start temperature)−100° C.) to a Bs point (a bainite transformation start temperature) at an average cooling speed of 3° C./s or more, further followed by heating and holding at the temperature region for 60 to 1800 sec (t2).

When the heating and holding temperature (T1) exceeds ($Ac_3$ point+50° C.) or the heating and holding time (t1) exceeds 1800 sec, grain growth of the austenite is caused to unfavorably deteriorate the workability (stretch-flanging properties). On the other hand, when the (T1) becomes lower than a temperature of the $Ac_3$ point, a predetermined bainitic ferrite texture is not obtained. Furthermore, when the (t1) is less than 10 sec, since the austenization is not sufficiently carried out, cementite and other alloy carbide unfavorably remain. The (t1) is set at preferably in the range of 30 to 600 sec and more preferably in the range of 60 to 400 sec.

In the next place, when the steel sheet is cooled, it is cooled at the average cooling speed of 3° C./sec or more. This is because a pearlite transformation region is avoided to inhibit a pearlite texture from generating. The average cooling speed that is the larger, the better is recommended to set preferably at 5° C./s or more and more preferably at 10° C./s or more.

Then, after the steel sheet is quenched at the cooling speed to the heating and holding temperature (T2), when the isothermal transformation is applied, a predetermined texture is introduced. When the heating and holding temperature (T2) here exceeds a Bs point, pearlite that is not favorable to the invention is generated much; accordingly, a bainitic ferrite texture is not sufficiently secured. On the other hand, the (T2) becomes lower that (Ms point−100° C.), the residual austenite is unfavorably decreased.

Furthermore, when the heating and holding time (t2) exceeds 1800 sec, other than that the dislocation density of the bainitic ferrite becomes smaller to be less in the trapping amount of hydrogen, the predetermined residual austenite is not obtained. On the other hand, also when the heating and holding time (t2) is less than 60 sec, the predetermined bainitic ferrite texture is not obtained. The heating and holding time (t2) is set preferably at 90 sec or more and 1200 sec or less and more preferably at 120 sec or more and 600 sec or less. The cooling method after the heating and holding is not particularly restricted. That is, any one of air cooling, quenching, gas and water cooling and so on may be used. Still furthermore, an existence form of the residual austenite in the steel sheet is controlled by controlling the cooling speed, the heating and holding temperature (T2), heating and holding time (t2) and so on during production. For instance, when the heating and holding temperature (T2) is set toward a lower temperature side, the residual austenite small in the average axis ratio may be formed.

When an actual operation is considered, the heat treatment (annealing treatment) is conveniently carried out by use of a continuous annealing equipment or a batch annealing equipment. When a cold rolled sheet is plated to apply hot dip galvanizing, the heat treatment may be applied in the plating step by setting the plating conditions so as to satisfy the foregoing heat treatment conditions.

Furthermore, in a hot rolling step (as needs arise, a cold rolling step) prior to the continuous annealing treatment, without particularly restricting other than the hot rolling finishing temperature, usually practicing conditions may be appropriately selected to adopt. Specifically, in the hot rolling step, conditions such that the hot rolling is applied at the $Ar_3$ point (austenite-ferrite transformation start temperature) or more, followed by cooling at an average cooling speed of substantially 30° C./sec, further followed by winding at a temperature substantially in the range of 500 to 600° C. are adopted. Still furthermore, when a shape after the hot rolling is poor, cold rolling may be applied to correct a shape. Here, the cold rolling rate is recommended to set in the range of 1 to 70%. When the cold rolling rate exceeds 70% in the cold rolling, the rolling load increases to be difficult to roll.

The invention aims at a steel sheet (thin steel sheet) without restricting a product form to particular one. That is, to the hot-rolled steel sheet, further cold-rolled steel sheet and steel sheet annealed after hot rolling or cold rolling, the plating such as the chemical conversion treatment, hot-dip plating, electroplating and vapor deposition, various kinds of coating, undercoat treatment, organic film treatment may be applied. Furthermore, the plating may be any one of usual zinc plating, aluminum plating and so on. The plating may be any one of the hot dipping and electroplating.

Furthermore, after the plating, the alloying heat treatment may be applied or the multi-layer plating may be applied. Still furthermore, a steel sheet where a film is laminated on a non-plated steel sheet or a plated steel sheet is neither outside of the invention.

In the case of coating, in accordance with various kinds of applications, the chemical conversion treatment such as a phosphate treatment may be applied, or electrodeposition coating may be applied. In the paint, known resins such as an epoxy resin, fluorinated resin, silicone-acryl resin, polyurethane resin, acryl resin, polyester resin, phenol resin, alkyd resin and melamine resin may be used together with known curing agents. From the viewpoint of, in particular, the corrosion resistance, the epoxy resin, fluorinated resin and silicone-acryl resin are recommended to use. Other than the above, known additives that are added to the paint such as a coloring pigment, coupling agent, leveling agent, sensitizer, antioxidant, UV-ray stabilizer and flame retardant may be added.

Furthermore, a paint form is not particularly restricted. A solvent paint, powder paint, aqueous paint, aqueous dispersion paint and electrodeposition paint may be appropriately selected in accordance with applications. In order to form a desired coated layer with the paint on the steel material, known methods such as a dipping method, roll coater method, spray method and curtain flow coater method may be used. As a thickness of the coated layer, depending on the applications, a known appropriate value is used.

The ultrahigh-strength thin steel sheet of the invention may be applied to automobile strengthening parts (such as reinforcement members such as a bumper and a door impact beam) and in-door parts such as a seat rail and so on. Parts obtained by molding and working like this as well have sufficient material properties (mechanical strength, stiffness and so on) and the shock absorbing property and exert excellent hydrogen embrittlement resistance (delayed fracture resistance).

Furthermore, as another preferable embodiment of the invention, (2) below is cited (hereinafter, in some cases, simply referred to as the second embodiment of the invention).

(2) An ultrahigh-strength thin steel sheet excellent in hydrogen embrittlement resistance, the steel sheet including, by weight %, more than 0.25% but not more than 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities;

in which a metallographic texture of the steel sheet after tensile process at a working rate of 3% contains 1% or more of residual austenite in terms of an area ratio with respect to the metallographic texture; and in which, in the metallographic texture, grains of the residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

Here, an ultrahigh-strength thin steel sheet excellent in the hydrogen embrittlement resistance according to a second embodiment of the invention contains a steel sheet that includes, by weight %, more than 0.25% but not more than 0.60% of C, 1.0 to 3.0% of Si, 1.0 to 3.5% of Mn, 0.15% or less of P, 0.02% or less of S, 1.5% or less of Al, 0.003 to 2.0% of Cr, and a balance including iron and inevitable impurities, in which a metallographic texture of the steel sheet after tensile process at a working rate of 3% contains 1% or more of residual austenite in terms of an area ratio with respect to the metallographic texture; and in which, in the metallographic texture, grains of the residual austenite have an average axis ratio (major axis/minor axis) of 5 or more, the grains of the residual austenite have an average minor axis length of 1 μm or less, and the grains of the residual austenite have a nearest-neighbor distance between the grains of 1 μm or less.

When the ultrahigh-strength thin steel sheet of the second embodiment of the invention is thus configured, since predetermined amounts of C, Si, Mn, P, Al and Cr are contained, the mechanical strength of the steel sheet is enhanced and the residual austenite is effectively generated in the steel sheet. When the area ratio and the dispersion state (average axis ratio, average minor axis length, a nearest-neighbor distance) of the residual austenite after tensile process at a working rate of 3% are stipulated, not aggregate but fine lath-shaped residual austenite is dispersed in the steel. Since the fine lath-shaped austenite exerts the hydrogen trap capability overwhelmingly larger than that of carbide in the steel sheet, hydrogen intruding owing to the atmospheric corrosion is rendered practically harmless. Furthermore, in particular, when a predetermined amount of Cr is contained, coarse carbide does not precipitate in the steel sheet and fine carbide is dispersed, resulting in enhancing the hydrogen trap capability and inhibiting the crack from propagating.

The ultrahigh-strength thin steel sheet of the second embodiment of the invention preferably contains a metallographic texture after tensile process at a working rate of 3% includes, in terms of an area ratio with respect to the metallographic texture, bainitic ferrite and martensite in a total amount of 80% or more and ferrite and pearlite in a total amount of 0 to 9%.

When the ultrahigh-strength thin steel sheet of the second embodiment of the invention is thus configured, since a matrix of the steel sheet is constituted of bainitic ferrite and martensite, the mechanical strength of the steel sheet is further improved and a starting point of the intergranular fracture is eliminated.

In the ultrahigh-strength thin steel sheet of the second embodiment of the invention, the steel sheet preferably further contains, by weight %, at least one of 0.003 to 0.5% of Cu and 0.003 to 1.0% of Ni.

When the ultrahigh-strength thin steel sheet of the second embodiment of the invention is thus configured, since, owing to the inclusion of predetermined amounts of Cu and Ni, thermodynamically stable protective rust is promoted to generate, even under a severe corrosive environment, the hydrogen-assisted crack and the like are sufficiently inhibited from occurring to improve the corrosion resistance, resulting in further improving the hydrogen embrittlement resistance.

In the ultrahigh-strength thin steel sheet according to the second embodiment of the invention, the steel sheet preferably further contains, by weight %, at least one of Ti, V, Zr and W in a total amount of 0.003 to 1.0%.

When the ultrahigh-strength thin steel sheet of the second embodiment of the invention is thus configured, since a predetermined amount of Ti, V, Zr and W is contained, the mechanical strength of the steel sheet is further improved. Furthermore, the texture of the steel sheet is finely particulated, resulting in further improving the hydrogen trapping capacity. Furthermore, thermodynamically stable protective rust is promoted to generate to improve the corrosion resistance, resulting in further improving the hydrogen embrittlement resistance.

In the ultrahigh-strength thin steel sheet according to the second embodiment of the invention, the steel sheet preferably further contains, by weight %, at least one of 1.0% or less of Mo and 0.1% or less of Nb.

When the ultrahigh-strength thin steel sheet of the second embodiment of the invention is thus configured, since predetermined amounts of Mo and Nb are contained, the mechanical strength of the steel sheet is further improved. Furthermore, since the texture of the steel sheet is finely particulated and the residual austenite is more effectively generated, the hydrogen trapping capability is further improved.

In the ultrahigh-strength thin steel sheet according to the second embodiment of the invention, the steel sheet preferably further contains, by weight %, at least one of 0.2% or less of Mo and 0.1% or less of Nb.

When the ultrahigh-strength thin steel sheet of the second embodiment of the invention is thus configured, since predetermined amounts of Mo and Nb are contained, a prior-to coating treatment is uniformized and the coating adhesiveness is improved.

In the ultrahigh-strength thin steel sheet according to the second embodiment of the invention, the steel sheet preferably further contains, by weight %, 0.0002 to 0.01% of B.

When the ultrahigh-strength thin steel sheet of the second embodiment of the invention is thus configured, since a predetermined amount of B is contained, the mechanical strength of the steel sheet is further improved and, owing to the concentration of B in a grain boundary, the grain boundary cracking is inhibited from occurring.

In the ultrahigh-strength thin steel sheet according to the second embodiment of the invention, the steel sheet preferably further contains, by weight %, at least one kind selected from the group consisting of 0.0005 to 0.005% of Ca, 0.0005 to 0.01% of Mg and 0.0005 to 0.01% of REM.

When the ultrahigh-strength thin steel sheet of the second embodiment of the invention is thus configured, since predetermined amounts of Ca, Mg and REM are contained, since a hydrogen ion concentration in an interface environment resulting from corrosion of a steel sheet surface is inhibited from going up, the corrosion resistance is improved, resulting in further improving the hydrogen embrittlement resistance.

In what follows, the second embodiment of the invention will be described in detail below.

In the case of tempered martensite steel or a combination of martensite and ferrite steel, which have been generally adopted as a high strength steel material, the hydrogen-induced delayed fracture is considered caused in such a manner that hydrogen is accumulated in a prior austenite grain boundary to form a void and the portion works as a starting point of the hydrogen-induced delayed fracture. Accordingly, in order to lower the susceptibility of the delayed fracture, it has been considered general resolving means to uniformly and finely disperse trap sites of hydrogen such as carbide to trap hydrogen there to lower a concentration of diffusive hydrogen. However, even when the trap sites of hydrogen such as carbide are dispersed a lot, since there is a limit in the trapping capability, the hydrogen-induced delayed fracture is not sufficiently inhibited.

Furthermore, when coarse inclusions are present in steel (in the neighborhood of the grain boundary, in particular), it is considered that the stress due to deformation is concentrated on the inclusions to promote the cracking. In order to inhibit this from occurring, it is preferred that a texture is contrived so as not to contain the coarse inclusions in the steel to avoid the stress concentration.

In this connection, in order to achieve higher grade hydrogen embrittlement resistance (delayed fracture resistance) that sufficiently considers a usage environment in an ultrahigh-strength thin steel sheet (hereinafter, referred to as steel sheet), with paying attention to detoxification of hydrogen (intensification of hydrogen trapping capacity), the inventors studied specific means thereof.

As a result, it was found effective to form residual austenite which is very high in the hydrogen trapping capability and the hydrogen storage capability. However, when the residual austenite which is very high in the hydrogen storage capacity is present as a coarse aggregate, voids tend to be formed to form starting points of fracture under the stress load. In order that the residual austenite, while sufficiently exerting the hydrogen trapping action, may not be starting points of fracture, a form of the residual austenite has to be controlled in a fine lath-shape. The residual austenite in a general TRIP steel is formed in aggregates of micrometer order. However, in the second embodiment of the invention, the residual austenite is formed in a sub-micrometer order and has a fine lath-shape. The residual austenite, when formed in a fine lath-like shape, is not unnecessarily deformed during the working; accordingly, the residual austenite is secured even after the working. The stabilization of the residual austenite during the working does not affect on the deterioration of the transformation induced workability of the TRIP steel.

Furthermore, it is found that when, a metallographic texture after tensile process at a working rate of 3% in the steel sheet includes 1% or more of a residual austenite in terms of an area ratio with respect to the metallographic texture (a total texture of the steel sheet) and the residual austenite is present dispersed in the steel sheet so that a dispersion form may satisfy that an average axis ratio (major axis/minor axis) of the grains of the residual austenite is 5 or more, an average minor axis length of grains of the residual austenite is 1 μm or less, and the nearest-neighbor distance between the grains of the residual austenite is 1 μm or less, without adding a particular alloy element, the hydrogen embrittlement resistance (delayed fracture properties, assisted cracking resistance and the like) in a steel sheet is sufficiently enhanced, thereby achieving the second embodiment of the invention. The processing rate is here specified at 3% because, as a result of various kinds of experiments that were conducted assuming a working situation of actual parts, when the tensile process was carried out at the processing rate of 3%, correlation between results of the various kinds of experiments and cracking of actual parts was excellent. In what follows, an area ratio and a dispersion form of the residual austenite according to the second embodiment of the invention will be described.

<Residual Austenite Being 1% or More in Terms of the Area Ratio>

From the viewpoint of the hydrogen absorptivity of the residual austenite, and, from the viewpoint of the hydrogen embrittlement resistance (hydrogen embrittlement resistance properties), that is, in order to exert, after a part is formed, excellent hydrogen embrittlement resistance properties even under a severe working condition over a long time, in the second embodiment of the invention, a metallographic texture after the steel sheet is stretched at the processing rate of 3% necessarily contains, in terms of the area ratio with respect to the metallographic texture, 1% or more of the residual austenite. The area ratio is preferably 2% or more and more preferably 3% or more. When the residual austenite is present 15% or more, since a problem in that the mechanical strength becomes difficult to secure is caused, the upper limit thereof is preferably set at 15%. The area ratio is preferably set at 14% or less and more preferably at 13% or less.

Furthermore, from the viewpoint of the stability of the residual austenite, a C concentration ($C_{\gamma R}$) in the residual austenite is recommended to be 0.8% by weight or more. When the $C_{\gamma R}$ is controlled to 0.8% by weight or more, the elongation and so on may be effectively enhanced. The $C_{\gamma R}$ is preferably 1.0% by weight or more and more preferably 1.2% by weight or more. The higher the $C_{\gamma R}$ is, the more desirable. However, from the viewpoint of actual operation, practically controllable upper limit is considered substantially 1.6% by weight.

<Average Axis Ratio (Major Axis/Minor Axis) of the Grains of the Residual Austenite Being 5 or More>

Figure 4:
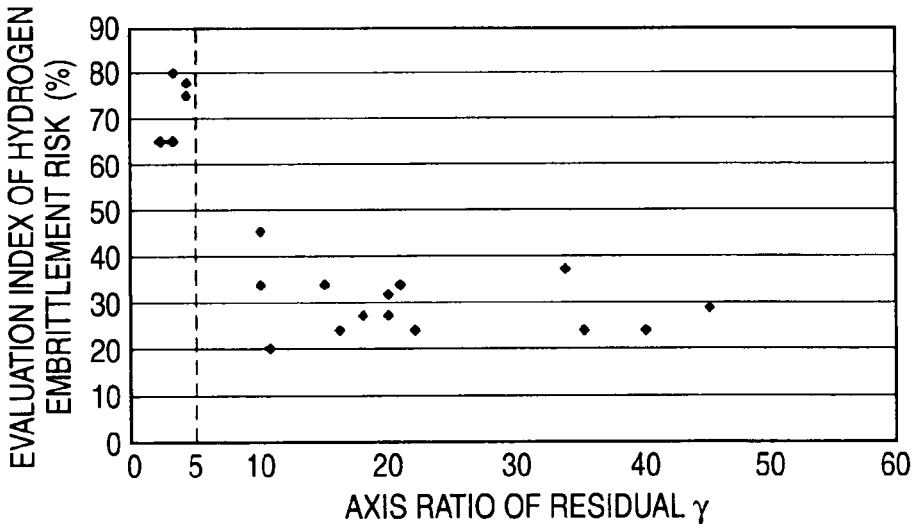
FIG. 4 is a graph showing relationship between an average axis ratio of the grains of the residual austenite and an evaluation index of the hydrogen embrittlement risk in a second embodiment of the invention.

FIG. 4 is a graph showing, in the second embodiment of the invention, relationship between an average axis ratio (residual γ axis ratio in FIG. 4) of the grains of the residual austenite measured by a method described below and an evaluation index of hydrogen embrittlement risk (measured by a method shown in a following example and means that the smaller the numerical value is, the more excellent the hydrogen embrittlement resistance is).

From FIG. 4, it is found that, in a metallographic texture after tensile process at a working rate of 3% in the steel sheet, in particular when the average axis ratio of the grains of the residual austenite is 5 or more, the evaluation index of the hydrogen embrittlement risk rapidly decreases. This is considered because, when the average axis ratio of the grains of the residual austenite becomes such high as 5 or more, the hydrogen absorption capability that the residual austenite intrinsically has is sufficiently exerted, the hydrogen trapping capacity becomes far larger than that of carbide, hydrogen that intrudes due to so-called atmospheric corrosion is practically detoxified, whereby, a remarkable improvement in the hydrogen embrittlement resistance is exerted.

On the other hand, the upper limit of the average axis ratio is not specified particularly from the viewpoint of enhancing the hydrogen embrittlement resistance. However, in order to make the TRIP effect exert effectively, a thickness of the residual austenite is necessary to a certain extent. Accordingly, the upper limit is preferably set at 30 and more preferably set at 20 or less.

<Average Minor Axis Length of the Grains of the Residual Austenite Being 1 μm or Less>

Figure 3:
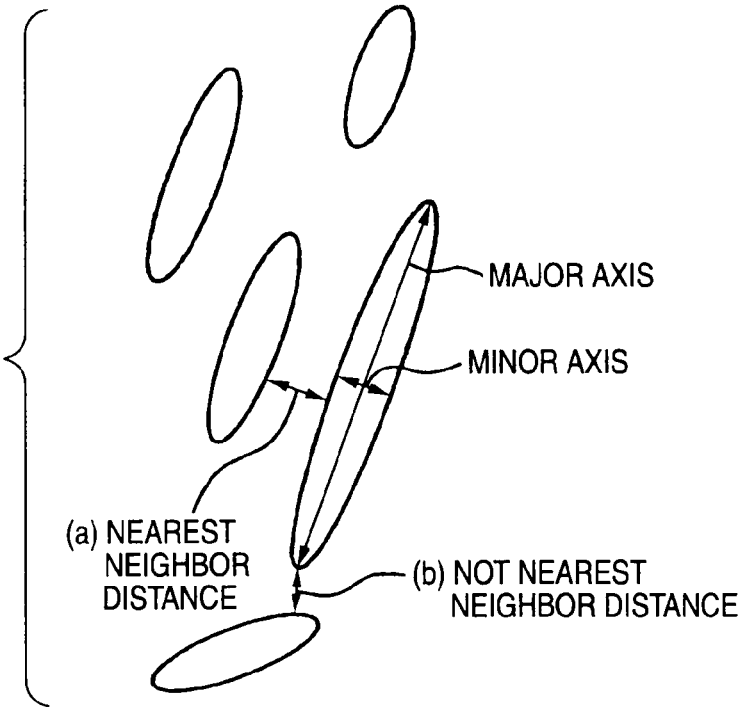
FIG. 3 is a diagram schematically showing the grains of the residual austenite in a second embodiment of the invention.

FIG. 3 is a diagram schematically showing the grains of (lath-shaped) residual austenite. It is found that, as shown in FIG. 3, in a metallographic texture after tensile process at a working rate of 3% in the steel sheet, when the grains of the residual austenite, which have the average minor axis length of 1 μm or less, are dispersed, the hydrogen embrittlement resistance is improved. This is considered because, when fine residual austenite grains having a short average minor axis length are dispersed a lot, a surface area of the residual austenite becomes larger to increase the hydrogen trapping capacity. Furthermore, the average minor axis length is preferably 0.5 μm or less and more preferably 0.25 μm or less.

<The Nearest-Neighbor Distance Between the Grains of the Residual Austenite Being 1 μm or Less>

As shown in FIG. 3, it was found that, in a metallographic texture after tensile process at a working rate of 3% in the steel sheet, when the nearest-neighbor distance between the grains of residual austenite is controlled, the hydrogen embrittlement resistance is more enhanced. This is considered because, when fine lath-shaped residual austenite grains are finely dispersed, the fracture is inhibited from propagating.

Furthermore, the nearest-neighbor distance is preferably 0.8 μm or less and more preferably 0.5 μm or less. The residual austenite means a region that is observed as a FCC (face-centered cubic lattice) by use of a FE-SEM (Field Emission type Scanning Electron Microscope) provided with an EBSP (Electron Back Scatter diffraction Pattern) detector. In the EBSP, an electron beam is inputted on a sample surface, and a Kikuchi pattern obtained from reflected electrons generated at this time is analyzed to determine a crystal orientation at an electron incident position. When an electron beam is scanned two-dimensionally on a sample surface and a crystal orientation is measured every determined pitch, an orientation distribution on a sample surface is measured.

An example of measurement will be cited. At a position one fourth a sheet thickness, an arbitrary measurement area (substantially 50 μm×50 μm, measurement distance: 0.1 μm) in a plane in parallel with a rolled plane is taken as a target of measurement. When the polishing is applied to the measurement plane, in order to inhibit the residual austenite from transforming, electrolytic polishing is applied. In the next place, by use of the "FE-SEM provided with EBSP", an EBSP image is taken with a high-sensitivity camera and taken in as an image in a computer. An image analysis is carried out and a FCC phase determined by comparing with a pattern owing to simulation with a known crystal system (FCC (face-centered cubic lattice) in the case of residual austenite) is color-mapped. Thus, an area ratio of the mapped region is obtained and this is taken as the area ratio of the residual austenite texture. As hard ware and soft ware according to the above-mentioned analysis, an OIM (Orientation Imaging Microscopy™) system (available from TexSEM Laboratories Inc.) may be used.

Measurement methods of the average axis ratio, average minor axis length and nearest-neighbor distance of the grains of the residual austenite are as shown below. In the beginning, the average axis ratio of the grains of the residual austenite is obtained in such a manner that a TEM is used to observe (multiplying factor: 15,000 times, for instance), major axes and minor axes (see FIG. 3) of the grains of the residual austenite present in arbitrarily selected three viewing fields are measured to obtain axis ratios, and an average value thereof is calculated as an average axis ratio. The average minor axis length of the grains of the residual austenite is obtained by calculating an average value of minor axes measured as mentioned above. The nearest-neighbor distance between the grains of the residual austenite is obtained in such a manner that a TEM is used to observe (multiplying factor: 15,000 time, for instance), in arbitrarily selected three viewing fields, distances between the grains of the residual austenite arranged in a major axis direction, which are shown as (a) in FIG. 3, are measured, the minimum value thereof is taken as the nearest-neighbor distance, and the nearest-neighbor distances of three viewing fields are averaged to obtain the nearest-neighbor distance. The nearest-neighbor distance here means, as shown in (a) of FIG. 3, to two residual austenite grains arranged in a major axis direction, a distance between minor axes of the residual austenite. A distance of two residual austenite grains not arranged in a major axis direction such as shown in (b) of FIG. 3 is not the nearest-neighbor distance.

In order to further improve the hydrogen embrittlement resistance (delayed fracture property) of the steel sheet, the inventors studied specific means thereof with paying attention to eliminate starting points of the intergranular fracture.

As a result, it is found effective to form a matrix phase of a steel sheet into not a single phase texture of martensite but a two phase texture of ferrite and martensite. In martensite, carbide such as film-like cementite or the like precipitates to be likely to cause the intergranular fracture. On the other hand, bainitic ferrite that is, different from general (polygonal) ferrite, planar ferrite, high in the dislocation density, high in the mechanical strength of a whole texture, free from carbide that becomes a starting point of the intergranular fracture and high in the hydrogen trapping capacity; accordingly, bainitic ferrite is most preferable as a matrix phase of a steel sheet.

In the second embodiment of the invention, in order to effectively exert the hydrogen trapping capacity like this, a metallographic texture after tensile process at a working rate of 3% in the steel sheet includes bainitic ferrite and martensite in total, preferably 80% or more and more preferably 85% or more in terms of an area ratio with respect to the metallographic texture. On the other hand, the upper limit thereof is determined from a balance with other texture (residual austenite), and, when a ferrite texture is not contained, the upper limit is controlled to 99%.

A steel sheet of the second embodiment of the invention may be formed of only the foregoing texture (that is, a mixed texture of bainitic ferrite and martensite with the residual austenite). However, within a range that does not damage an action of the invention, as other texture, polygonal ferrite or pearlite may be contained. Although these are textures that inevitably remain in a producing process of the invention, the slighter is the more preferable. In the second embodiment of the invention, in the metallographic texture after tensile process at a working rate of 3%, the area ratio to the metallographic texture is suppressed to 9% or less, preferably to less than 5% and more preferably to less than 3%.

The bainitic ferrite in the invention is planar ferrite and means a lower texture high in the dislocation density. On the other hand, polygonal ferrite or pearlite is free from dislocation or has a lower texture extremely less in the dislocation, has a polygonal shape and does not contain the residual austenite or martensite inside thereof.

The area ratios of (bainitic ferrite and martensite) and (polygonal ferrite and pearlite) are obtained as shown below. That is, a steel sheet is corroded with nital, an arbitrary measurement area (substantially 50×50 μm) in a plane in parallel with a rolled plane is observed at a position one fourth a sheet thickness by use of the FE-SEM (multiplying factor: 1500 times), the color adjustment is applied to discern the textures, and the area ratios are calculated. The bainitic ferrite and martensite show up deep gray color in the SEM photograph (in the case of SEM, in some cases, bainitic ferrite and the residual austenite or martensite are not separated and differentiated); however, since polygonal ferrite and pearlite are shown black in the SEM photograph, these are clearly discerned.

The invention is, as mentioned above, characterized in that the area ratio and the dispersion form of the residual austenite are controlled. However, in order to control the area ratio of the residual austenite and the dispersion form thereof and to obtain a steel sheet that exerts stipulated mechanical strength, a component composition has to be controlled as shown below.

<C: More Than 0.25 to 0.60% by Weight>

An element of C is an element necessary for securing the mechanical strength of the steel sheet. Furthermore, C is an element necessary for enhancing a C concentration ($C_{\gamma R}$) in the residual austenite. The residual austenite is transformed to martensite when the steel sheet is processed (deformed). However, when the C concentration in the residual austenite is high, the stability of the residual austenite is increased to be difficult to deform more than necessary. As a result, the residual austenite is secured in the processed steel sheet to be able to maintain excellent hydrogen embrittlement resistance properties. In the second embodiment of the invention, in order to attain the advantage of the second embodiment of the invention, C is necessarily added exceeding 0.25% by weight. When an amount of C is deficient, the workability is deteriorated. An amount of C is set preferably at 0.27% by weight or more and more preferably at 0.30% by weight or more. However, from the viewpoint of securing the corrosion resistance, in the invention, an amount of C is suppressed to 0.60% by weight or less, preferably to 0.55% by weight or less and more preferably to 0.50% by weight or less.

When the amount of C in the steel sheet is thus heightened, a C concentration ($C_{\gamma R}$) in the residual austenite is readily heightened.

<Si: 1.0 to 3.0% by Weight>

Then, Si is an element important for effectively inhibiting the residual austenite from decomposing to generate carbide and a substitutional solid-solution hardening element that largely hardens a material. In order to effectively exert such an advantage, Si is necessarily contained 1.0% by weight or more (preferably 1.2% by weight or more and more preferably 1.5% by weight or more). However, when Si is contained exceeding 3.0% by weight, a scale is remarkably formed during the hot rolling and it costs much to remove the flaw to be economically disadvantageous; accordingly, the upper limit is set at 3.0% by weight (preferably 2.5% by weight or less and more preferably 2.0% by weight or less).

<Mn: 1.0 to 3.5% by Weight>

An element of Mn is necessary to stabilize austenite and to obtain desired residual austenite, desired mechanical strength and elongation and is necessarily contained 1.0% by weight or more (preferably 1.2% by weight or more and more preferably 1.5% by weight or more). On the other hand, when Mn is contained much, the segregation becomes remarkable to, in some cases, deteriorate the workability; accordingly, the upper limit is set at 3.5% by weight (preferably at 3.0% by weight).

<P: 0.15% by Weight or Less (Not Including 0% by Weight)>

An element of P is an element that helps cause the intergranular fracture due to the grain boundary segregation and is preferable to be contained less; accordingly, the upper limit is set at 0.15% by weight, preferably at 0.10% by weight or less and more preferably at 0.05% by weight or less.

<S: 0.02% by Weight or Less (Not Including 0% by Weight)>

Since an element of S is an element that helps absorb hydrogen under a corrosive environment and is preferably contained less, the upper limit is set at 0.02% by weight.

<Al: 1.5% by Weight or Less (Not Including 0% by Weight)>

An element of Al may be added 0.01% by weight or more to deoxidize. It has an advantage of inhibiting hydrogen from intruding into steel owing to the concentration of Al on a surface of the steel sheet, and a content thereof is preferably set at 0.02% by weight or more (preferably at 0.2% by weight or more and more preferably at 0.5% by weight or more). Furthermore, Al not only deoxidizes but also works so as to improve the corrosion resistance and hydrogen embrittlement resistance. It is considered that, when Al is added, the corrosion resistance is improved to result in decreasing an amount of hydrogen generated owing to the atmospheric corrosion, and, as a result thereof, the hydrogen embrittlement resistance as well is improved. Still furthermore, it is considered that, when Al is added, the lath-like residual austenite is further stabilized to contribute to improve the hydrogen embrittlement resistance. However, when an addition amount of Al is increased, inclusions such as alumina and so on are increased to deteriorate the workability; accordingly, the upper limit is set at 1.5% by weight.

<Cr: 0.003 to 2.0% by Weight>

An element of Cr is very effective when it is contained in the range of 0.003 to 2.0% by weight. It is considered that, when Cr is added, the hardenability is improved to enable to readily secure the mechanical strength of the steel sheet and the corrosion resistance is improved to reduce an amount of hydrogen generated owing to the atmospheric corrosion to result in improving the hydrogen embrittlement resistance. Furthermore, in the invention, it is found that, by studying heat treatment conditions and so on, even when Cr is added, without precipitating coarse carbide in steel, fine carbide is dispersed in the steel, and, by studying a composition range, the residual austenite is effectively generated. Whereby, it is considered that addition of Cr contributes to improve the hydrogen trapping capability and to inhibit the cracking from propagating. The advantage is more effectively exerted when Cu and Ni described below are used together.

In order to exert the advantages, the lower limit value of the addition amount is necessarily set at 0.003% by weight (preferably at 0.1% by weight or more and more preferably at 0.3% by weight or more). Furthermore, when Cr is added excessively, the advantages saturate and the workability is deteriorated; accordingly, the upper limit value is set at 2.0% by weight (preferably at 1.5% by weight or less and more preferably at 1.0% by weight or less). Still furthermore, Cr has an adverse effect of promoting the under film corrosion. Accordingly, in order to improve the corrosion resistance after coating, Cr is added as small as possible in the above range.

A component composition stipulated in the invention is as follows. That is, a balance component is substantially made of Fe, as inevitable impurities incorporated in the steel owing to raw materials, materials, producing equipment and so on, 0.001% by weight or less of N and so on is contained, and, to an extent that does not adversely affect on the advantages of the invention, elements below may be positively contained.

<Cu: 0.003 to 0.5% by Weight and/or Ni: 0.003 to 1.0% by Weight>

It is very effective to contain Cu: 0.003 to 0.5% by weight and/or Ni: 0.003 to 1.0% by weight. In more detail, when Cu and/or Ni is/are present, since the corrosion resistance of the steel sheet per se is improved, hydrogen is sufficiently inhibited from generating owing to the corrosion of the steel sheet. Furthermore, the elements have an advantage in promoting formation of iron oxide: $\alpha$-FeOOH that is mentioned to be thermodynamically stable and have the protective property among rust generated in air. Accordingly, when the generation of the rust is promoted and, whereby, the generated hydrogen is inhibited from intruding into the steel sheet, under a severe corrosive environment, the hydrogen-assisted fracture is sufficiently inhibited from occurring. In order to exert the advantages, when Cu and/or Ni is/are contained, the respective contents are set necessarily at 0.003% by weight or more, preferably at 0.05% by weight or more and more preferably at 0.1% by weight or more. Furthermore, when any one of the both is contained excessively, the workability is deteriorated; accordingly, the upper limits are set respectively at 0.5% by weight and 1.0% by weight.

<Ti, V, Zr, W: 0.003 to 1.0% by Weight in Total>

An element of Ti has the generation promoting effect of the protective rust similarly to Cu, Ni and Cr. The protective rust has a very useful advantage in that $\beta$-FeOOH that is generated in particular under a chloride environment to adversely affect on the corrosion resistance (resultantly the hydrogen embrittlement resistance) is inhibited from generating. The generation of such the protective rust is promoted when, in particularly, Ti and V (or Zr, W) are added in combination. An element of Ti is an element that imparts very excellent corrosion resistance and has as well an advantage of cleaning the steel.

Furthermore, V is an element that is effective, in addition to having, as mentioned above, an advantage of improving the hydrogen embrittlement resistance in a combination with Ti, in improving the mechanical strength of the steel sheet and finely particulating of prior $\gamma$-grain (prior austenite) and, when a shape of carbide is controlled, in playing a function effective as hydrogen trap. That is, V is, in combination with Ti and Zr, effective in improving the hydrogen embrittlement resistance.

An element of Zr is an element effective in improving the mechanical strength of the steel sheet and finely particulating of prior $\gamma$-grain and coexists with Ti to improve the hydrogen embrittlement resistance.

An element of W is effective in improving the mechanical strength of the steel sheet and a precipitate thereof is effective as a hydrogen trap as well. Furthermore, generated rust rejects a chloride ion to contribute to improve the corrosion resistance as well. In combination with Ti and Zr, the corrosion resistance and hydrogen embrittlement resistance are effectively improved.

In order to sufficiently exert the advantages of Ti, V, Zr and W, these are necessarily contained 0.003% by weight or more in total (preferably 0.01% by weight or more). When these are added excessively, carbide is precipitated much to result in deteriorating the workability. Accordingly, these are necessarily added in the range of 1.0% by weight or less in total and preferably 0.5% by weight or less.

<Mo: 1.0% by Weight or Less (Not Including 0% by Weight)>

An element of Mo is an element necessary for stabilizing austenite and obtaining desired residual austenite. The element is effective not only in inhibiting hydrogen from intruding to improve the delayed fracture properties and enhancing the hardenability of the steel sheet but also in strengthening the grain boundary to inhibit the hydrogen embrittlement from occurring. However, when an addition amount thereof exceeds 1.0% by weight, these advantages saturate; accordingly, the upper limit value is set at 1.0% by weight, preferably at 0.8% by weight or less and more preferably at 0.5% by weight or less.

Furthermore, when Mo is added exceeding a specified amount, a prior-to coating treatment is made non-uniform to deteriorate the corrosion resistance after coating. In addition, a problem in production such that the mechanical strength of the hot-rolled material becomes very high to be difficult to roll is exposed. Furthermore, Mo is very expensive element to be economically disadvantageous from the viewpoint of cost. From the viewpoints, when the corrosion resistance after coating as well is expected, Mo is necessarily added 0.2% by weight or less, preferably 0.03% by weight or less and more preferably 0.005% by weight or less.

<Nb: 0.1% by Weight or Less (Not Including 0% by Weight)>

An element of Nb is an element very effective in improving the mechanical strength of the steel sheet and finely particulating of prior γ-grain. In particular, in a combination with Mo, a synergetic effect is exerted. However, since, when an amount of Nb exceeds 0.1% by weight, the advantage saturates, the upper limit value is set at 0.1% by weight.

<B: 0.0002 to 0.01% by Weight>

An element of B is an element effective in improving the mechanical strength of the steel sheet. Furthermore, when Mo is reduced to improve the corrosion resistance after coating of the steel sheet, the strength deficiency due to a decrease in an amount of Mo is necessarily compensated by adding B. In the second embodiment of the invention, in order to improve the mechanical strength, B is necessarily contained 0.0002% by weight or more (preferably 0.0008% by weight or more and more preferably 0.0015% by weight or more). This is because when B is contained less than 0.0002% by weight, the advantage is not obtained; accordingly, the lower limit value is set at 0.0002% by weight. Furthermore, B homogenizes a prior-to coating treatment such as a phosphate treatment to improve the coating adhesiveness (corrosion resistance after coating). Though a mechanism is unknown, when Ti is added 0.01% by weight or more in the steel, the advantage is more exerted. Furthermore, it is more preferred to contain 0.03% by weight or more of Ti and 0.0005% by weight or more of B. Still furthermore, B has an advantage of strengthening the grain boundary to improve the delayed fracture resistance. On the other hand, when B is contained exceeding 0.01% by weight, the hot workability is deteriorated; accordingly, the upper limit value is set at 0.01% by weight and more preferably at 0.005% by weight or less.

<At Least One Kind Selected from the Group Consisting of Ca: 0.0005 to 0.005% by Weight, Mg: 0.0005 to 0.01% by Weight and REM: 0.0005 to 0.01% by Weight>

These elements are effective in suppressing a rise of a hydrogen ion concentration of an interface environment accompanying corrosion of a steel surface, that is, in suppressing the pH from decreasing. Furthermore, these control a form of a sulfide in the steel to be effective in improving the workability. However, when each of these is contained less than 0.0005% by weight, the advantage is not obtained; accordingly, the lower limit value thereof is set at 0.0005% by weight. Furthermore, when these are contained excessively, since the workability is deteriorated, the upper limit values, respectively, are set at 0.005% by weight, 0.01% by weight and 0.01% by weight.

The invention does not specify to the producing conditions. However, in order to form the above-mentioned texture that is ultrahigh in the mechanical strength and exerts excellent hydrogen embrittlement resistance from the steel sheet that satisfies the component composition, it is recommended to set a finishing temperature in the hot rolling at a temperature that is in a supercooled austenite region that does not generate ferrite and as low as possible. When the finishing rolling is applied at the temperature, austenite of a hot rolled steel sheet is finely particulated, resulting in a fine texture of an end product.

Furthermore, it is recommended to apply heat treatment according to a procedure shown below after the hot rolling or the cold rolling following the hot rolling.

That is, it is recommended that the steel that satisfies the foregoing component composition is heated and held at a heating and holding temperature (T1) in the range of a $Ac_3$ point (a temperature where a ferrite-austenite transformation comes to completion) to ($Ac_3$ point+50° C.) for 10 to 1800 sec (t1), followed by cooling to a heating and holding temperature (T2) in the range of (Ms point (a martensite transformation start temperature)−100° C.) to a Bs point (a bainite transformation start temperature) at an average cooling speed of 3° C./s or more, further followed by heating and holding at the temperature region for 60 to 1800 sec (t2).

When the heating and holding temperature (T1) exceeds ($Ac_3$ point+50° C.) or the heating and holding time (t1) exceeds 1800 sec, grain growth of the austenite is caused to unfavorably deteriorate the workability (stretch-flanging properties). On the other hand, when the (T1) becomes lower than a temperature of the $Ac_3$ point, a predetermined bainitic ferrite texture is not obtained. Furthermore, when the (t1) is less than 10 sec, since the austenization is not sufficiently carried out, cementite and other alloy carbide unfavorably remain. The (t1) is set at preferably in the range of 30 to 600 sec and more preferably in the range of 60 to 400 sec.

In the next place, when the steel sheet is cooled, it is cooled at the average cooling speed of 3° C./sec or more. This is because a pearlite transformation region is avoided to inhibit a pearlite texture from generating. The average cooling speed that is the larger, the better is recommended to set preferably at 5° C./s or more and more preferably at 10° C./s or more.

Then, after the steel sheet is quenched at the cooling speed to the heating and holding temperature (T2), when the isothermal transformation is applied, a predetermined texture is introduced. When the heating and holding temperature (T2) here exceeds a Bs point, pearlite that is not favorable to the invention is generated much; accordingly, a bainitic ferrite texture is not sufficiently secured. On the other hand, the (T2) becomes lower that (Ms point−100° C.), the residual austenite is unfavorably decreased.

Furthermore, when the heating and holding time (t2) exceeds 1800 sec, other than that the dislocation density of the bainitic ferrite becomes smaller to be less in the trapping amount of hydrogen, the predetermined residual austenite is not obtained. On the other hand, also when the heating and holding time (t2) is less than 60 sec, the predetermined bainitic ferrite texture is not obtained. The heating and holding time (t2) is set preferably at 90 sec or more and 1200 sec or less and more preferably at 120 sec or more and 600 sec or less. The cooling method after the heating and holding is not particularly restricted. That is, any one of air cooling, quenching, gas and water cooling and so on may be used. Still furthermore, an existence form of the residual austenite in the steel sheet is controlled by controlling the cooling speed, the heating and holding temperature (T2), heating and holding time (t2) and so on during production. For instance, when the heating and holding temperature (T2) is set toward a lower temperature side, the residual austenite small in the average axis ratio may be formed.

When an actual operation is considered, the heat treatment (annealing treatment) is conveniently carried out by use of a continuous annealing equipment or a batch annealing equipment. When a cold rolled sheet is plated to apply hot dip galvanizing, the heat treatment may be applied in the plating step by setting the plating conditions so as to satisfy the foregoing heat treatment conditions.

Furthermore, in a hot rolling step (as needs arise, a cold rolling step) prior to the continuous annealing treatment, without particularly restricting other than the hot rolling finishing temperature, usually practicing conditions may be appropriately selected to adopt. Specifically, in the hot rolling step, conditions such that the hot rolling is applied at the $Ar_3$ point (austenite-ferrite transformation start temperature) or more, followed by cooling at an average cooling speed of substantially 30° C./sec, further followed by winding at a temperature substantially in the range of 500 to 600° C. are adopted. Still furthermore, when a shape after the hot rolling is poor, cold rolling may be applied to correct a shape. Here, the cold rolling rate is recommended to set in the range of 1 to 70%. When the cold rolling rate exceeds 70% in the cold rolling, the rolling load increases to be difficult to roll.

The invention aims at a steel sheet (thin steel sheet) without restricting a product form to particular one. That is, to the hot-rolled steel sheet, further cold-rolled steel sheet and steel sheet annealed after hot rolling or cold rolling, the electrodeposition coating for automobile, the plating such as the chemical conversion treatment, hot-dip plating, electroplating and vapor deposition, various kinds of coating, undercoat treatment, and organic film treatment may be applied.

Furthermore, the plating may be any one of usual zinc plating, aluminum plating and so on. The plating may be any one of the hot dipping and electroplating. Furthermore, after the plating, the alloying heat treatment may be applied or the multi-layer plating may be applied. Still furthermore, a steel sheet where a film is laminated on a non-plated steel sheet or a plated steel sheet is neither outside of the invention.

In the case of coating, in accordance with various kinds of applications, the chemical conversion treatment such as a phosphate treatment may be applied, or electrodeposition coating may be applied. In the paint, known resins such as an epoxy resin, fluorinated resin, silicone-acryl resin, polyurethane resin, acryl resin, polyester resin, phenol resin, alkyd resin and melamine resin may be used together with known curing agents. From the viewpoint of, in particular, the corrosion resistance, the epoxy resin, fluorinated resin and silicone-acryl resin are recommended to use. Other than the above, known additives that are added to the paint such as a coloring pigment, coupling agent, leveling agent, sensitizer, antioxidant, UV-ray stabilizer and flame retardant may be added.

Furthermore, a paint form is not particularly restricted. A solvent paint, powder paint, aqueous paint, aqueous dispersion paint and electrodeposition paint may be appropriately selected in accordance with applications. In order to form a desired coated layer with the paint on the steel material, known methods such as a dipping method, roll coater method, spray method and curtain flow coater method may be used. As a thickness of the coated layer, depending on the applications, a known appropriate value is used.

The ultrahigh-strength thin steel sheet of the invention may be applied to automobile strengthening parts (such as reinforcement members such as a bumper and a door impact beam) and in-door parts such as a seat rail and so on. Parts obtained by molding and working like this as well have sufficient material properties (mechanical strength, stiffness and so on) and the shock absorbing property and exert excellent hydrogen embrittlement resistance (delayed fracture resistance).

In what follows, the invention will be more specifically described with reference to examples. However, the invention is not restricted to examples below. The invention is appropriately modified and carried out within a range that is adaptable to a gist of the invention. All these are incorporated in the technical range of the invention.

EXAMPLE

In what follows, first and second examples according to the first embodiment of the invention will be described.

First Example

After steels (steel grades A to V) of which component compositions are shown in Table 1 were vacuum melted to form slabs, according to a procedure (hot rolling→cold rolling→continuous annealing) below, hot rolled steel sheets having a sheet thickness of 3.2 mm were obtained, followed by washing with acid to remove a surface scale, further followed by cold rolling to 1.2 mm, still further followed by continuously annealing as shown below, thereby, various kinds of steel sheets (experiment No. 1 to 23) were prepared.

<Hot Rolling Step>
Start Temperature: holding for 30 min at 1150 to 1250° C.
Finish Temperature: 850° C.
Cooling Speed: 40° C./s
Winding Temperature: 550° C.

<Cold Rolling Step>
Cold Rolling Rate: 50%

<Continuous Annealing Step>

Steel sheets of experiment No. 1 to 15, 17 to 19 and 21 to 23, after the cold rolling, were held at a temperature in the range of a $Ac_3$ point (see Table 1) to the $Ac_3$ point+30° C. for 120 sec, followed by quenching (air cooling) at an average cooling speed of 20° C./s to a To° C. of Table 2, further followed by holding for 240 sec at the To ° C., further followed by carrying out the gas and water cooling to room temperature. A steel sheet of experiment No. 16 that is made of martensite steel that is an existing high strength steel and uses a steel grade (P), after the cold rolling, was held at 880° C. for 30 min, followed by water-hardening, further followed by tempering at 300° C. for 1 hour. Furthermore, in order to investigate an influence that the producing conditions affect on a texture of a steel sheet, in a steel sheet of experiment No. 20, a steel grade (A) was used, the steel sheet after the cold rolling was held at a temperature of a $Ac_3$ point−50° C. for 120 sec, followed by quenching (air cooling) at an average cooling speed of 20° C./s to To° C. of Table 2, further followed by holding at the To° C. for 240 sec, still further followed by applying gas and water cooling to room temperature.

Of each of the respective steel sheets thus obtained, a metallographic texture, the tensile strength (TS), the elongation (total elongation (EL)), the hydrogen embrittlement resistance properties (evaluation index of hydrogen embrittlement risk) and the weldability were investigated and evaluated according to procedures shown below. Results are shown in Table 2.

(Metallographic Texture)

An arbitrary measurement region (substantially 50 μm×50 μm, measurement distance: 0.1 μm) in a plane in parallel with a rolled plane at a position one fourth a sheet thickness of each of steel sheets was observed and photographed by use of a FE-SEM (trade name: XL30S-FEG, produced by Phillips Co., Ltd.) and the area ratios of bainitic ferrite (BF) and martensite (M) and the area ratio of the residual austenite (residual γ) were measured according to the method described above. In two arbitrarily selected viewing fields, similar measurements were carried out, followed by obtaining an average value. Furthermore, other texture (ferrite, pearlite and so on) was obtained by subtracting the area ratios of the textures (BF, M, residual austenite) from a total texture (100%).

Still furthermore, of grains of the residual γ, the average axis ratio, average minor axis length and nearest-neighbor distance between grains were measured according to the methods mentioned above. In a first example, one that is 5 or more in the average axis ratio, 1 μm (1000 nm) or less in the average minor axis length and 1 μm (1000 mm) or less in the nearest-neighbor distance is evaluated as satisfying requisites of the invention (○) and one that is less than 5 in the average axis ratio, exceeding 1 μm (1000 nm) in the average minor axis length and exceeding 1 μm (1000 mm) in the nearest-neighbor distance is evaluated as not satisfying requisites of the invention (x).

(Tensile Strength, Elongation)

The tensile test was carried out with a JIS #5 test piece to measure the tensile strength (TS) and the elongation (EL). At the tensile test, a strain rate was set at 1 mm/sec. In the first example, among the steel sheets where the tensile strength measured according to the foregoing method is 980 MPa or more, one having the elongation of 10% or more was evaluated as "excellent in the elongation".

(Evaluation Index of Hydrogen Embrittlement Risk: Evaluation of Hydrogen Embrittlement Resistance)

By use of a planar test piece having a sheet thickness of 1.2 mm, a slow stretching rate tensile (SSRT) test was carried out at the stretching rate of $1\times10^{-4}$ mm/sec, and the evaluation index of hydrogen embrittlement risk (%) defined by a formula (1) below was obtained to evaluate the hydrogen embrittlement resistance.

$$\text{Evaluation index of hydrogen embrittlement risk } (\%)=100\times(1-E1/E0) \quad (1)$$

Here, E0shows the elongation when a test piece that does not substantially contain hydrogen in the steel is ruptured and E1 shows the elongation at the rupture when hydrogen is intruded in the steel sheet (test piece) by a combined cycle test where a severe corrosion environment is assumed by setting a wetting time longer. In the combined cycle test, with a combination of showering 5% saline water for 8 hours and executing a constant temperature and constant humidity test at (temperature) 35° C. and (humidity) 60% RH for 16 hours as one cycle, 7 cycles were carried out. Since, when the evaluation index of hydrogen embrittlement risk exceeds 50%, the hydrogen embrittlement is likely to be caused in use, the evaluation index of hydrogen embrittlement risk was evaluated as excellent in the hydrogen embrittlement resistance when the index was 50% or more.

(Evaluation of Weldability)

The weldability test was carried out of steel sheets of experiment No. 7 (steel grade (G)) and experiment No. 14 (steel grade (N)). The weldability test was conducted on the test pieces made from a steel sheet having a thickness of 1.2 mm according to the procedures of JIS Z 3136 and JIS Z 3137, followed by carrying out spot welding under the following conditions, further followed by carrying out a tensile shear test (the maximum load was measured at the tensile velocity of 20 mm/min) and cross tension test (the maximum load was measured at the tensile velocity of 20 mm/min), thereby, the tensile shear strength (TSS) and cross tensile strength (CTS) were obtained. When the ductility ratio (CTS/TSS) expressed by a ratio of the cross tensile strength (CTS) to the tensile shear strength (TSS) is 0.2 or higher, the weldability was evaluated as excellent. As a result, it was found that experiment No. 14 (comparative steel sheet) was 0.19 in the ductility ratio, that is, poor in the weldability (expressed by × in Table 2). On the other hand, the ductility ratio of experiment No. 7 (steel sheet of the invention) was 0.23, that is, excellent in the weldability (expressed by ○ in Table 2).

<Conditions of Spot Welding>

Initial pressurization time: 60 cycles/60 Hz, Pressurized force 450 kgf (4.4 kN)

Energizing time: 1 cycle/60 Hz

Welding current: 8.5 KA

TABLE 1

| Steel Grade | Component Composition (% by weight) | | | | | | | | | | | | | | | $Ac_3$ | Bs | Ms |
|---|---|---|---|---|---|---|---|---|---|---|---|---|---|---|---|---|---|---|
| Mark | C | Si | Mn | P | S | Al | Cr | Cu | Ni | Ti | V | Nb | Mo | B | Others | (° C.) | (° C.) | (° C.) |
| A | 0.23 | 1.53 | 2.2 | 0.012 | 0.002 | 0.033 | 0.2 | | | | | | | 0.0005 | | 834.4 | 555.9 | 376 |
| B | 0.17 | 1.5 | 2.52 | 0.011 | 0.002 | 0.032 | 0.3 | | | | | | 0.2 | | | 841.3 | 519.7 | 388 |
| C | 0.18 | 2.13 | 2.54 | 0.011 | 0.002 | 0.031 | 0.2 | | | | | 0.04 | | | REM: 0.005 | 860.8 | 538.8 | 388.5 |
| D | 0.2 | 2.04 | 2.51 | 0.011 | 0.002 | 0.03 | 0.3 | | | | | 0.05 | 0.2 | | | 857.8 | 512.5 | 374.1 |
| E | 0.23 | 1.64 | 2.13 | 0.011 | 0.002 | 0.031 | 0.4 | 0.3 | 0.3 | | | | | 0.0005 | | 827.2 | 537.1 | 369.8 |
| F | 0.19 | 1.97 | 2.96 | 0.011 | 0.002 | 0.03 | 0.3 | 0.4 | 0.3 | 0.03 | | | 0.2 | | Mg: 0.005<br>Ca: 0.003 | 842.9 | 463.6 | 358.9 |
| G | 0.2 | 1.99 | 2.5 | 0.011 | 0.002 | 0.032 | 0.7 | 0.3 | 0.2 | | 0.05 | 0.08 | 0.2 | | | 848.4 | 478 | 364.2 |
| H | 0.21 | 1.98 | 2.47 | 0.011 | 0.002 | 0.033 | 0.4 | 0.3 | 0.3 | 0.05 | | 0.05 | 0.8 | | | 882.5 | 445.5 | 351.3 |
| I | 0.22 | 1.97 | 2.5 | 0.011 | 0.002 | 0.031 | 0.7 | 0.3 | 0.3 | 0.03 | | 0.05 | 0.2 | | | 848 | 468.9 | 353 |
| J | 0.21 | 1.98 | 2.52 | 0.011 | 0.002 | 0.033 | 0.5 | 0.3 | 0.2 | 0.05 | | 0.05 | 0.2 | | | 862.5 | 487.5 | 362.2 |
| K | 0.2 | 1.5 | 2.48 | 0.012 | 0.002 | 0.033 | 0.5 | 0.3 | 0.2 | 0.05 | | 0.04 | 0.2 | | | 845.2 | 493.8 | 368.3 |
| L | 0.23 | 1.51 | 2.51 | 0.011 | 0.002 | 0.032 | 0.6 | 0.3 | 0.3 | 0.05 | | 0.06 | 0.2 | | | 834.5 | 472.3 | 349.7 |
| M | 0.2 | 1.48 | 2.51 | 0.011 | 0.002 | 0.033 | 0.6 | 0.3 | 0.3 | 0.05 | | 0.05 | 0.2 | | | 840.1 | 480.4 | 363.9 |
| N | 0.31 | 2 | 1.96 | 0.014 | 0.005 | 0.031 | 0.6 | | | | | 0.06 | 0.2 | | | 849.5 | 511.3 | 335 |
| O | 0.25 | 2.54 | 0.9 | 0.014 | 0.005 | 0.031 | 0.2 | | | | 0.05 | 0.05 | 0.2 | | | 926.5 | 650.9 | 405.2 |
| P | 0.2 | 0.23 | 1.99 | 0.014 | 0.002 | 0.043 | 0.3 | | | | | 0.05 | 0.2 | | | 799.8 | 559.3 | 391.2 |
| Q | 0.05 | 2.03 | 2.11 | 0.012 | 0.002 | 0.033 | 0.7 | | | | | 0.06 | 0.2 | | Mg: 0.005<br>Ca: 0.004 | 912.2 | 561 | 451.6 |
| R | 0.21 | 2.02 | 1.5 | 0.012 | 0.002 | 0.033 | | | | | | 0.06 | 0.2 | | | 890.2 | 621.7 | 407.8 |
| S | 0.2 | 2 | 1.2 | 0.012 | 0.002 | 0.031 | 2.5 | | | | | 0.05 | 0.2 | | | 872.2 | 476.4 | 379.9 |
| T | 0.21 | 1.48 | 2.11 | 0.012 | 0.002 | 0.031 | 0.2 | | | | | 0.05 | 0.02 | 0.001 | | 839.1 | 567.7 | 388 |

TABLE 1-continued

| Steel Grade | Component Composition (% by weight) | | | | | | | | | | | | | | | $Ac_3$ | Bs | Ms |
|---|---|---|---|---|---|---|---|---|---|---|---|---|---|---|---|---|---|---|
| Mark | C | Si | Mn | P | S | Al | Cr | Cu | Ni | Ti | V | Nb | Mo | B | Others | (° C.) | (° C.) | (° C.) |
| U | 0.19 | 1.52 | 2.53 | 0.011 | 0.002 | 0.031 | 0.03 | 0.3 | 0.1 | 0.02 | | 0.05 | 0.01 | 0.0023 | | 834.1 | 544.4 | 385 |
| V | 0.22 | 1.58 | 2.49 | 0.011 | 0.002 | 0.031 | 0.003 | 0.3 | 0.05 | 0.05 | | 0.05 | | 0.0023 | | 844 | 544.4 | 373.6 |

(Note)
A balance is made of Fe and inevitable impurities

TABLE 2

| | Experiment No. | Steel Grade Mark | To (° C.) | Area ratio (%) Residual γ | BF + M | Others | Dispersion Form of Residual γ: Average Axial Ratio | Average Minor Axis Length (nm) | Nearest-neighbor Distance (nm) | Evaluation | TS (MPa) | EL (%) | Evaluation Index of Hydrogen Embrittlement Risk (%) | Weldability |
|---|---|---|---|---|---|---|---|---|---|---|---|---|---|---|
| Example | 1 | A | 350 | 8 | 91 | 1 | 12 | 170 | 340 | ○ | 1301 | 13 | 35 | |
| | 2 | B | 350 | 9 | 90 | 1 | 10 | 220 | 440 | ○ | 1286 | 13 | 30 | |
| | 3 | C | 320 | 9 | 91 | 0 | 25 | 120 | 240 | ○ | 1326 | 13 | 32 | |
| | 4 | D | 320 | 7 | 92 | 1 | 18 | 140 | 280 | ○ | 1345 | 12 | 33 | |
| | 5 | E | 300 | 8 | 92 | 0 | 40 | 90 | 180 | ○ | 1454 | 10 | 25 | |
| | 6 | F | 300 | 8 | 92 | 0 | 50 | 80 | 160 | ○ | 1492 | 10 | 28 | |
| | 7 | G | 300 | 9 | 90 | 1 | 50 | 80 | 160 | ○ | 1473 | 10 | 23 | ○ |
| | 8 | H | 320 | 9 | 91 | 0 | 25 | 120 | 240 | ○ | 1450 | 11 | 27 | |
| | 9 | I | 300 | 8 | 91 | 1 | 40 | 90 | 180 | ○ | 1506 | 10 | 24 | |
| | 10 | J | 320 | 7 | 92 | 1 | 15 | 150 | 300 | ○ | 1465 | 11 | 16 | |
| | 11 | K | 300 | 8 | 92 | 0 | 50 | 80 | 160 | ○ | 1484 | 10 | 18 | |
| | 12 | L | 320 | 9 | 91 | 0 | 18 | 140 | 280 | ○ | 1503 | 10 | 22 | |
| | 13 | M | 300 | 8 | 92 | 0 | 40 | 90 | 180 | ○ | 1495 | 10 | 21 | |
| Comparative Example | 14 | N | 350 | 5 | 94 | 1 | 1.5 | 1600 | 3200 | X | 1520 | 9 | 70 | X |
| | 15 | O | 350 | 5 | 94 | 1 | 2 | 1500 | 3000 | X | 1043 | 14 | 65 | |
| | 16 | P | 300 | less than 1 | 99 | less than 1 | — | — | — | X | 1417 | 7 | 75 | |
| | 17 | Q | 350 | 4 | 96 | 0 | 2.5 | 1400 | 2800 | X | 940 | 15 | 35 | |
| | 18 | R | 320 | 6 | 94 | 0 | 3 | 800 | 1600 | X | 1080 | 12 | 85 | |
| | 19 | S | 320 | 6 | 94 | 0 | 2.5 | 1400 | 2800 | X | 1297 | 4 | 80 | |
| | 20 | A | 350 | 11 | 20 | 69 | 1.5 | 1300 | 2600 | X | 974 | 14 | 75 | |
| Example | 21 | T | 350 | 10 | 90 | 0 | 12 | 210 | 420 | ○ | 1030 | 14 | 20 | |
| | 22 | U | 320 | 8 | 91 | 1 | 35 | 130 | 270 | ○ | 1471 | 10 | 22 | |
| | 23 | V | 300 | 8 | 92 | 0 | 45 | 90 | 170 | ○ | 1512 | 10 | 19 | |

From Tables 1 and 2, steel sheets of experiments No. 1 to 13 and 21 to 23 (examples), which satisfy the requisites defined in the invention, are ultrahigh-strength steel sheets of 980 MPa or more provided with excellent hydrogen embrittlement resistance properties. Furthermore, since the elongation that the TRIP steel sheet should have and the weldability as well are excellent, the steel sheets may be mentioned most preferred for reinforcing parts of automobiles that are exposed to an atmospheric corrosive environment.

On the other hand, steel sheets of experiments No. 14 to 20 (comparative examples) that do not satisfy the requisites defined by the invention have inconveniences mentioned below. In a steel sheet of experiment No. 14, in which a C content is excessive, a dispersion form of the residual γ (residual austenite) was not satisfied, sufficient weldability was not obtained and the hydrogen embrittlement resistance was poor. In a steel sheet of experiment No. 15, because of deficiency of an amount of Mn, a dispersion form of the residual γ was not satisfied, the hardenability and so on were deteriorated and sufficient mechanical strength, elongation and hydrogen embrittlement resistance were not obtained. Experiment No. 16 is an example where a steel grade deficient in an amount of Si was used to obtain martensite steel that is an existing high strength steel. However, since the residual γ is hardly present, sufficient elongation and hydrogen embrittlement resistance were not obtained.

In a steel sheet of experiment No. 17, because an amount of C is deficient and the dispersion form of the residual γ is not satisfied, sufficient mechanical strength and hydrogen embrittlement resistance were not obtained. In a steel sheet of experiment No. 18, since Cr is not contained and the dispersion form of the residual γ is not satisfied, the hardenability was insufficient and sufficient mechanical strength and hydrogen embrittlement resistance were not obtained. In a steel sheet of experiment No. 19, since Cr is contained excessively and the dispersion form of the residual γ is not satisfied, coarse carbide was precipitated to result in difficulty in the workability and sufficient mechanical strength and hydrogen embrittlement resistance were not obtained.

In experiment No. 20, a steel grade (A) that satisfies a composition range defined by the invention was used. However, since the recommended producing condition (heating and holding temperature T1 at the time of annealing is a $Ac_3$ point−50° C.) was not adopted, an obtained steel sheet became a TRIP steel sheet. That is, the residual austenite, without satisfying the dispersion form defined by the invention, became aggregate and the matrix phase neither formed a two-phase texture of bainitic ferrite and martensite. Accordingly, sufficient mechanical strength and hydrogen embrittlement resistance were not obtained.

In the next place, by use of steel sheets of steel grades (B) and (G) shown in Table 1 and a comparative steel sheet (existing high strength steel sheet having the mechanical strength in a class of 590 MPa), parts were molded, followed by conducting the crush resistance test and impact resistance test as shown below to investigate performance as molded products.

(Crush Resistance Test)

Figure 5:
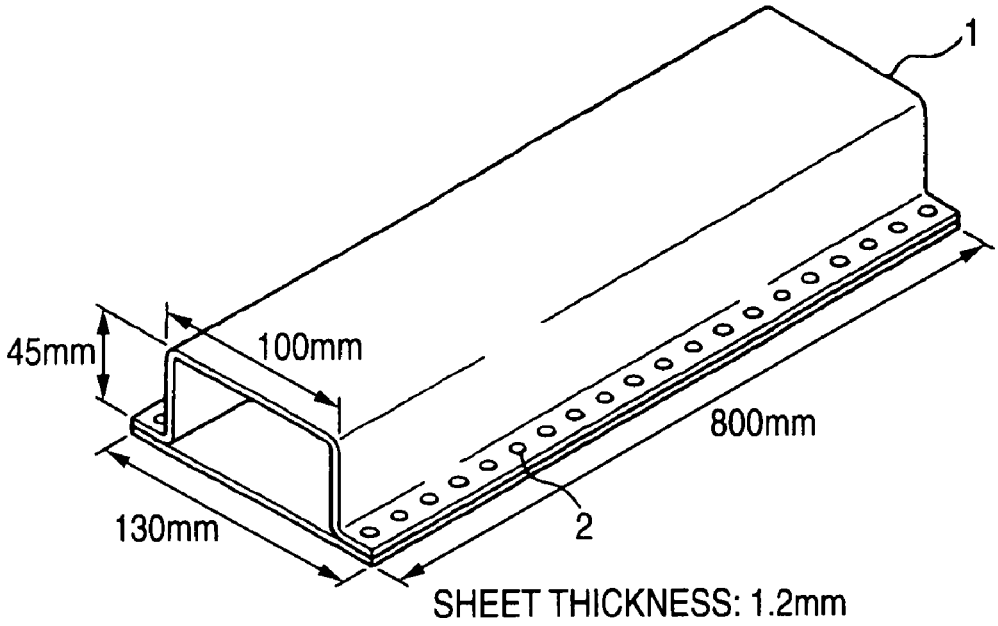
FIG. 5 is a schematic perspective view of a part that is used in a crush resistance test in an example.
Figure 6:
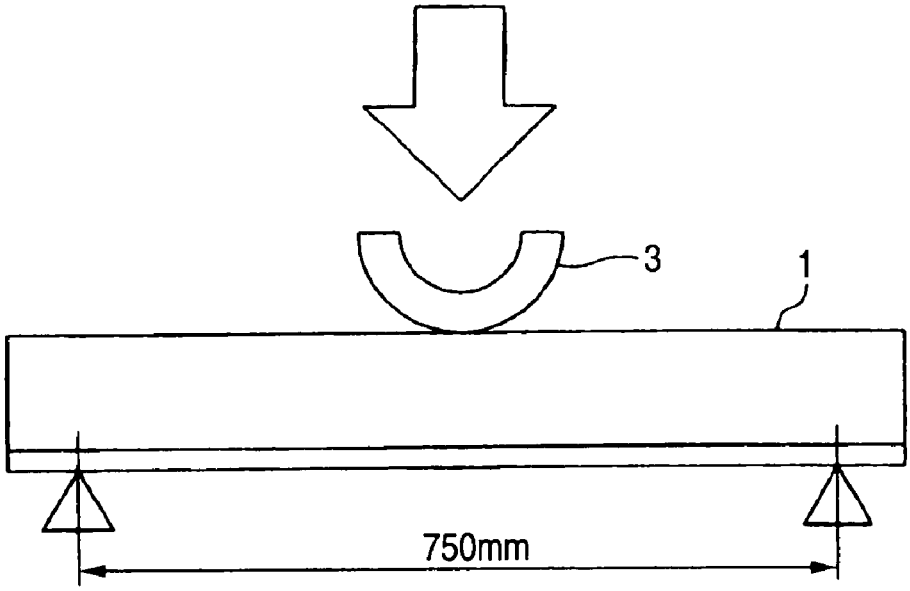
FIG. 6 is a side view schematically showing a situation of a crush resistance test in an example.

With each of steel sheets of steel grades (B) and (G) shown in Table 1 and a comparative steel sheet, a part (a test piece, a hat channel component) 1 shown in FIG. 5 was prepared, followed by carrying out the crush resistance test. To a spot welding position 2 of a part 1 shown in FIG. 5, from an electrode having a tip diameter of 6 mm, a current lower by 0.5 kA than a dust generation current was flowed to carry out the spot welding at a pitch of 35 mm as shown in FIG. 5. In the next place, as shown in FIG. 6, from an upper portion of a central portion in a longer direction of the part 1, a metal mold 3 was pressed down to obtain the maximum load. Furthermore, from an area of a load-displacement line graph, absorption energy was obtained. Results thereof are shown in Table 3.

TABLE 3

| Steel Sheet Used | | | | Evaluation Results of Test Pieces | |
|---|---|---|---|---|---|
| Steel Grade | TS (MPa) | EL (%) | Area ratio of Residual γ (%) | Maximum Load (kN) | Absorption Energy (kJ) |
| Mark B | 1286 | 13 | 8 | 12.1 | 0.61 |
| Mark G | 1473 | 10 | 9 | 14 | 0.68 |
| Comparative Steel | 604 | 22 | 0 | 5.7 | 0.33 |

From Table 3, it is found that parts (test pieces) prepared from steel sheets (steel grades B, G) of the invention show loads higher than that when a comparative steel sheet low in the mechanical strength is used and are higher in the absorption energy as well, that is, are excellent in the crush resistance.

(Impact Resistance Test)

Figure 7:
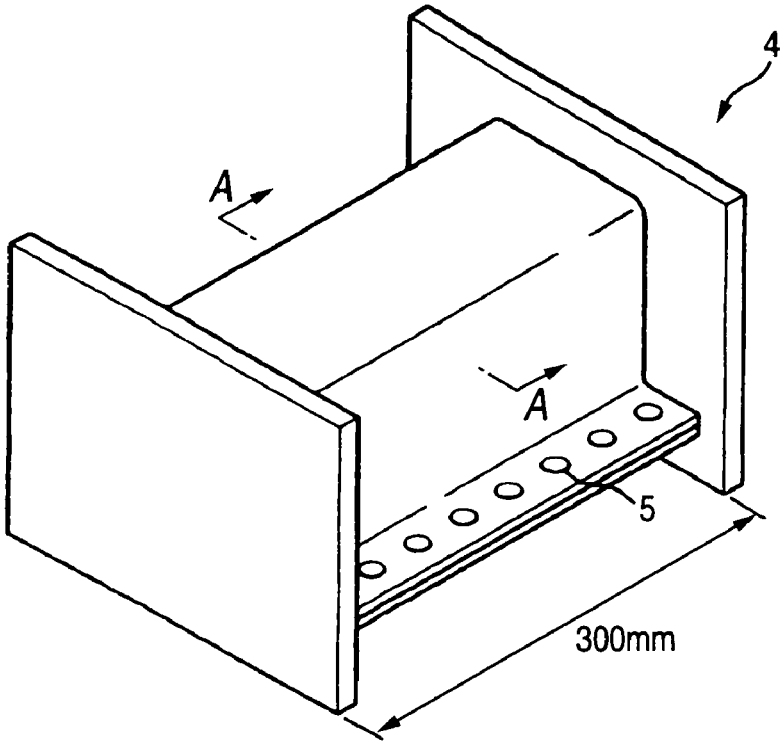
FIG. 7 is a schematic perspective view of a part that is used in an impact resistance test in an example.
Figure 8:
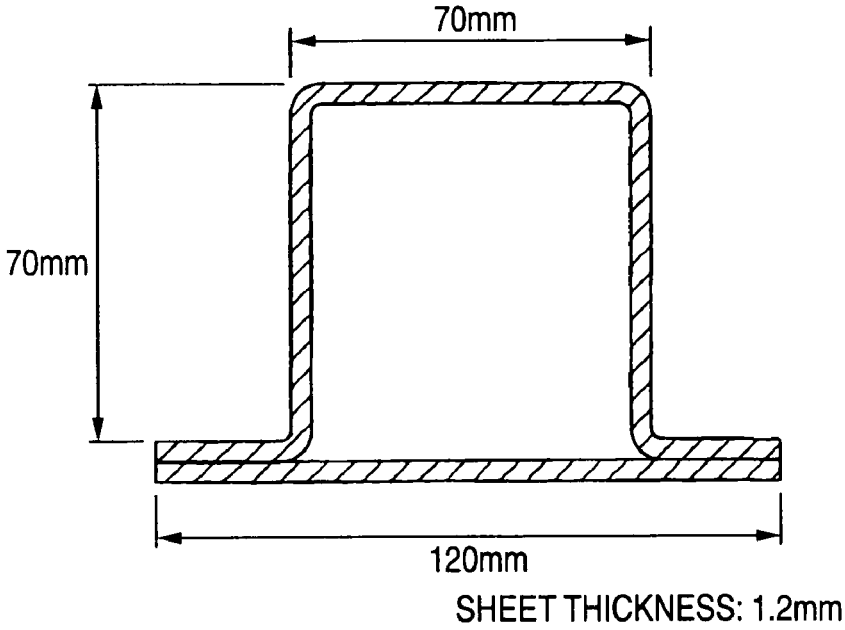
FIG. 8 is an A-A line sectional view in FIG. 7.
Figure 9:
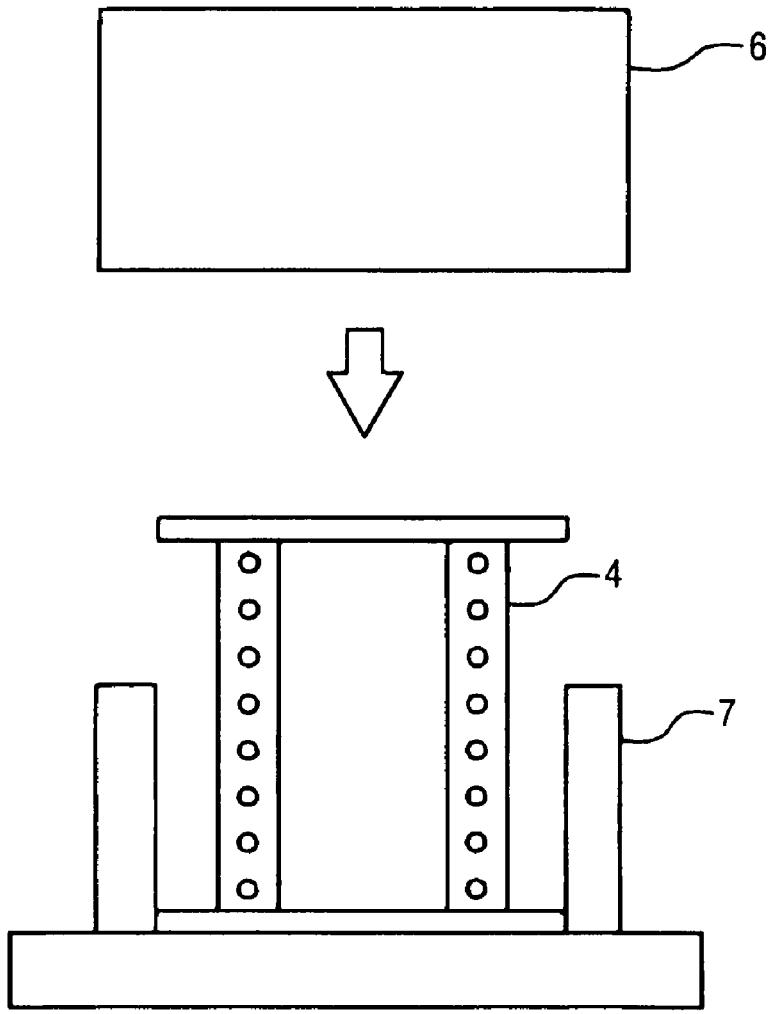
FIG. 9 is a side view schematically showing a situation of an impact resistance test in an example.

With each of steel sheets of steel grades (B) and (G) shown in Table 1 and a comparative steel sheet, a part (a test piece, a hat channel component) 4 such as shown in FIG. 7 was prepared, followed by carrying out the impact resistance test. FIG. 8 shows an A-A sectional view of a part 4 in the FIG. 7. In the impact resistance test, after spot welding was carried out to spot welding positions 5 of a part 4 similarly to the case of the crush resistance test, the part 4 was set on a base 7 as shown schematically in FIG. 9, from above the part 4, a weight (110 kg) 6 was fallen from a height of 11 m and, thereby, absorption energy until the part 4 was deformed by 40 mm (contraction in a height direction) was obtained. Results thereof are shown in Table 4.

TABLE 4

| Steel Sheet Used | | | | Evaluation Result of Test Piece |
|---|---|---|---|---|
| Steel Grade | TS (MPa) | EL (%) | Area ratio of Residual γ (%) | Absorption Energy (kJ) |
| Mark B | 1286 | 13 | 8 | 5.98 |
| Mark G | 1473 | 10 | 9 | 6.7 |
| Comparative Steel | 604 | 22 | 0 | 3.51 |

From Table 4, it is found that parts (test pieces) prepared from the steel sheets (steel grade B, G) of the invention have the absorption energy higher than that when an existing steel sheet lower in the mechanical strength is used, that is, are excellent in the impact resistance.

Second Example

After steels (steel grades 1 to 22) of which component compositions are shown in Table 5 were vacuum melted to form slabs, according to a procedure (hot rolling→cold rolling→continuous annealing) below, hot rolled steel sheets having a sheet thickness of 3.2 mm were obtained, followed by washing with acid to remove a surface scale, further followed by cold rolling to 1.2 mm, still further followed by continuously annealing as shown below, thereby, various kinds of steel sheets (experiment No. 24 to 46) were prepared.

<Hot Rolling Step>

Start Temperature: holding for 30 min at 1150 to 1250° C.

Finish Temperature: 850° C.

Cooling Speed: 40° C./s

Winding Temperature: 550° C.

<Cold Rolling Step>

Cold Rolling Rate: 50%

<Continuous Annealing Step>

Steel sheets of experiment No. 24 to 42, 44 and 45 were processed in such a manner that a cold rolled steel sheet was held at a temperature of a $Ac_3$ point +30° C. for 120 sec, followed by quenching (air cooling) at an average cooling speed of 20° C./s to To° C. shown in Table 6, further followed by holding at the To° C. for 240 sec, still further followed by gas and water cooling to room temperature. Furthermore, a steel sheet of experiment No. 43, which is made of martensite steel that is an existing high strength steel sheet that uses steel grade (20) was processed in such a manner that a cold rolled steel sheet was heated to 830° C. and held there for 5 min, followed by water hardening, further followed by tempering at 300° C. for 10 min. Still furthermore, a steel sheet of experiment No. 46, which uses steel grade (1) was processed in such a manner that a cold rolled steel sheet was heated to 800° C. and held there for 120 sec, followed by cooling at an average cooling speed of 20° C./s to 350° C. (To) and holding at the To° C. for 240 sec, further followed by gas and water cooling to room temperature.

The metallographic texture, tensile strength (TS), elongation (total elongation (EL)), hydrogen embrittlement resistance (delayed fracture resistance), corrosion resistance after coating and weldability of each of the steel sheets obtained thus were investigated respectively according to procedures shown below and evaluated. Results thereof are shown in Table 6. The metallographic texture, tensile strength, elongation and weldability were investigated similarly to the first example. In Table 6, one having the average axis ratio of the residual γ of 5 or more is expressed with (○) and one that is less than 5 is expressed with (x).

(Delayed Fracture Resistance: Evaluation of Hydrogen Embrittlement Resistance)

A strip piece of 120 mm×30 mm was cut out of each of the steel sheets, followed by bending so that an R of a curved portion may be 15 mm, and, thereby, a test piece for bending test was prepared. The test piece for bending test, with stress of 1000 MPa applied thereto, was dipped in an aqueous solution of 5% HCl, and a time until crack is caused was measured to evaluate the hydrogen embrittlement resistance. When the time until the crack is caused is 24 hr or more, the hydrogen embrittlement resistance was judged excellent.

(Evaluation of Corrosion Resistance after Coating)

By simulating a usage environment, the corrosion resistance after coating as well was evaluated.

A planar test chip having a sheet thickness of 1.2 mm was cut out of each of the steel sheets as a test piece. The test piece, after zinc phosphate treatment, was subjected to commercially available electrodeposition coating to form a coated film having a film thickness of 25 μm. To a center of a parallel portion of the test piece to which the electrodeposition coating was applied, a bruise that reaches a base was generated by use of a cutter, and, a bruised test piece was supplied to the corrosion test. After a definite interval, an expanse of the corrosion from the artificial bruise due to the cutter (blister width) was measured. The blister width was normalized with the blister width of the test piece of experiment No. 24 set at "1" and ranked as shown below to evaluate the corrosion resistance after coating. When the blister width was more than 1.0 and 1.5 or less, the corrosion resistance after coating was evaluated a little deteriorated (Δ), and, when the blister width was 1.0 or less, the corrosion resistance after coating was evaluated excellent (○–⊙⊙⊙).

In table 6, when the blister width was 0.7 or less, the corrosion resistance after coating was expressed by (⊙⊙⊙), when the blister width was more than 0.7 and 0.75 or less, the corrosion resistance after coating was expressed by (⊙⊙○), when the blister width was more than 0.75 and 0.8 or less, the corrosion resistance after coating was expressed by (⊙⊙), when the blister width was more than 0.8 and 0.85 or less, the corrosion resistance after coating was expressed by (⊙○), when the blister width was more than 0.85 and 0.9 or less, the corrosion resistance after coating was expressed by (⊙Δ), when the blister width was more than 0.9 and 0.95 or less, the corrosion resistance after coating was expressed by (⊙), when the blister width was more than 0.95 and 1.0 or less, the corrosion resistance after coating was expressed by (○) and when the blister width was more than 1.0 and 1.05 or less, the corrosion resistance after coating was expressed by (Δ).

Furthermore, the zinc phosphate treatment was carried out after a pretreatment (degreasing, water washing, surface control) that is applied when a usual phosphate treatment is applied, and the electrodeposition coating was applied with SD5000 (trade name, produced by Nippon Paint Co., Ltd.) at 45° C. for 2 min. A coated amount (coated film) of a coating was controlled by a treatment time of the zinc phosphate treatment.

Still furthermore, the corrosion test was carried out in such a manner that, to a test piece to which the electrodeposition coating was applied, an aqueous solution of NaCl was showered at 35° C., followed by drying at 60° C., further followed by carrying out, with an operation of leaving under an atmosphere of a temperature of 50° C. and the relative humidity of 95% as 1 cycle (8 hr), 3 cycles a day for 30 days.

TABLE 5

| Steel Grade | Component Composition (% by weight) | | | | | | | | | | | | | | | $Ac_3$ | Bs | Ms |
|---|---|---|---|---|---|---|---|---|---|---|---|---|---|---|---|---|---|---|
| Mark | C | Si | Mn | P | S | Al | Cr | Cu | Ni | Ti | V | Nb | Mo | B | Others | (° C.) | (° C.) | (° C.) |
| 1 | 0.18 | 1.58 | 2.57 | 0.011 | 0.002 | 0.032 | 0.03 | | | | | 0.05 | 0.06 | 0.001 | | 839.8 | 545.1 | 389.6 |
| 2 | 0.2 | 1.45 | 2.65 | 0.012 | 0.002 | 0.031 | 0.003 | | | | | 0.05 | 0.02 | 0.001 | | 826 | 535.8 | 378.3 |
| 3 | 0.16 | 1.51 | 2.53 | 0.011 | 0.002 | 0.033 | 0.003 | | | | | 0.05 | | 0.0004 | | 841.3 | 559.1 | 401.7 |
| 4 | 0.23 | 1.54 | 2.78 | 0.011 | 0.002 | 0.032 | 0.003 | | | | | 0.05 | | 0.001 | | 818.6 | 517.7 | 360.2 |
| 5 | 0.2 | 1.49 | 2.55 | 0.012 | 0.002 | 0.031 | 0.1 | | | | | 0.05 | | 0.002 | | 830.1 | 546.5 | 382.1 |
| 6 | 0.2 | 1.58 | 2.48 | 0.012 | 0.002 | 0.033 | 0.003 | 0.3 | | | | 0.05 | | 0.0025 | | 831 | 552.8 | 384.4 |
| 7 | 0.19 | 1.45 | 2.48 | 0.011 | 0.002 | 0.031 | 0.003 | | 0.3 | | | 0.05 | | 0.0024 | | 827.5 | 544.4 | 384 |
| 8 | 0.22 | 1.5 | 2.51 | 0.011 | 0.002 | 0.032 | 0.003 | 0.3 | 0.3 | | | 0.05 | | 0.0025 | | 816.5 | 533.6 | 368.8 |
| 9 | 0.19 | 1.58 | 2.53 | 0.011 | 0.002 | 0.031 | 0.003 | 0.3 | 0.05 | 0.02 | | 0.05 | | 0.0023 | | 837.6 | 549.2 | 386.6 |
| 10 | 0.22 | 1.58 | 2.53 | 0.011 | 0.002 | 0.031 | 0.003 | 0.3 | 0.05 | 0.05 | | 0.05 | | 0.0023 | | 842.9 | 541.1 | 372.4 |
| 11 | 0.2 | 1.45 | 2.53 | 0.011 | 0.002 | 0.1 | 0.003 | 0.3 | 0.3 | | | 0.05 | | 0.0025 | | 845.3 | 537.2 | 377.6 |
| 12 | 0.2 | 1.51 | 2.53 | 0.011 | 0.002 | 0.032 | 0.003 | 0.3 | 0.05 | 0.05 | 0.05 | 0.05 | | 0.0026 | Ca: 0.004 | 849.8 | 546.5 | 381.9 |
| 13 | 0.19 | 1.6 | 2.5 | 0.011 | 0.002 | 0.031 | 0.003 | 0.3 | 0.2 | 0.05 | | 0.05 | | 0.0026 | Ca: 0.004<br>Mg: 0.005 | 8491 | 546.3 | 385 |
| 14 | 0.22 | 1.59 | 2.68 | 0.011 | 0.002 | 0.032 | 0.003 | 0.3 | 0.2 | 0.04 | | 0.05 | | 0.0025 | Ca: 0.004<br>Mg: 0.005<br>REM: 0.005 | 832.9 | 522 | 364.9 |
| 15 | 0.31 | 1.55 | 2.51 | 0.14 | 0.005 | 0.031 | 0.51 | | | | | 0.05 | 0.02 | 0.001 | | 813.8 | 518.7 | 330.8 |
| 16 | 0.25 | 1.45 | 0.9 | 0.14 | 0.005 | 0.031 | 0.35 | | | | | 0.05 | 0.02 | 0.001 | | 869.1 | 679.8 | 412.4 |
| 17 | 0.2 | 0.16 | 2.53 | 0.14 | 0.002 | 0.043 | 0.28 | | | | | 0.05 | 0.02 | 0.001 | | 778.1 | 546.6 | 382.3 |
| 18 | 0.05 | 1.65 | 2.43 | 0.012 | 0.002 | 0.033 | 0.4 | | | | | 0.05 | 0.02 | 0.001 | | 887.7 | 596.1 | 456.7 |
| 19 | 0.21 | 1.6 | 2.5 | 0.012 | 0.002 | 0.033 | 0.71 | | | | | 0.3 | 0.02 | 0.001 | | 835.7 | 546.6 | 378.5 |
| 20 | 0.22 | 1.54 | 2.51 | 0.012 | 0.002 | 0.033 | 0.69 | | | | | 0.05 | 0.3 | | | 839.4 | 519.8 | 367.6 |
| 21 | 0.19 | 1.51 | 2.48 | 0.014 | 0.005 | 0.031 | 0.12 | | | | | 0.05 | 0.015 | | | 837.3 | 554.3 | 388.8 |
| 22 | 0.19 | 1.51 | 2.5 | 0.001 | 0.003 | 0.003 | 0.03 | | | | | | | | | 816.1 | 553.7 | 388.4 |

(Note)

A balance is made of Fe and inevitable impurities

TABLE 6

| | Experiment No. | Steel Grade Mark | To (° C.) | Area ratio (%) Residual γ | BF + M | Others | Dispersion Form of Residual γ: Average Axial Ratio | Average Minor Axis Length (nm) | Nearest-neighbor Distance (nm) | Evaluation | TS (MPa) | EL (%) | Delayed Fracture Properties (hour) | Corrosion Resistance after Coating | Weldability |
|---|---|---|---|---|---|---|---|---|---|---|---|---|---|---|---|
| Example | 24 | 1 | 320 | 6 | 93 | 1 | ○ | 120 | 220 | ○ | 1224 | 13 | exceeding 24 | ○ | ○ |
| | 25 | 2 | 320 | 6 | 94 | 0 | ○ | 130 | 210 | ○ | 1310 | 14 | exceeding 24 | ⊙ | |
| | 26 | 3 | 340 | 7 | 92 | 1 | ○ | 160 | 340 | ○ | 1192 | 14 | exceeding 24 | ⊙ | |
| | 27 | 4 | 300 | 6 | 93 | 1 | ○ | 90 | 170 | ○ | 1610 | 11 | exceeding 24 | ⊙Δ | |
| | 28 | 5 | 340 | 8 | 92 | 0 | ○ | 150 | 300 | ○ | 1359 | 11 | exceeding 24 | ⊙○ | |
| | 29 | 6 | 320 | 7 | 93 | 0 | ○ | 120 | 240 | ○ | 1422 | 11 | exceeding 24 | ⊙⊙ | |
| | 30 | 7 | 320 | 8 | 92 | 0 | ○ | 140 | 280 | ○ | 1430 | 11 | exceeding 24 | ⊙⊙ | |
| | 31 | 8 | 320 | 8 | 92 | 0 | ○ | 130 | 230 | ○ | 1425 | 12 | exceeding 24 | ⊙⊙ | |
| | 32 | 9 | 320 | 8 | 92 | 0 | ○ | 140 | 270 | ○ | 1440 | 11 | exceeding 24 | ⊙⊙ | |
| | 33 | 10 | 310 | 8 | 92 | 0 | ○ | 90 | 180 | ○ | 1510 | 12 | exceeding 24 | ⊙⊙○ | |
| | 34 | 11 | 310 | 7 | 92 | 1 | ○ | 80 | 160 | ○ | 1480 | 11 | exceeding 24 | ⊙⊙○ | |
| | 35 | 12 | 310 | 7 | 93 | 0 | ○ | 90 | 180 | ○ | 1495 | 11 | exceeding 24 | ⊙⊙⊙ | |
| | 36 | 13 | 310 | 6 | 94 | 0 | ○ | 100 | 200 | ○ | 1490 | 12 | exceeding 24 | ⊙⊙⊙ | |
| | 37 | 14 | 310 | 8 | 92 | 0 | ○ | 90 | 180 | ○ | 1533 | 11 | exceeding 24 | ⊙⊙⊙ | |
| | 38 | 15 | 320 | 6 | 94 | 0 | ○ | 200 | 440 | ○ | 1488 | 11 | exceeding 24 | Δ | |
| | 39 | 16 | 350 | 6 | 78 | 16 | ○ | 180 | 370 | ○ | 1098 | 12 | exceeding 24 | Δ | |
| | 40 | 17 | 320 | 6 | 94 | 0 | ○ | 130 | 230 | ○ | 1029 | 15 | exceeding 24 | ○ | |
| Comparative Example | 41 | 18 | 310 | 8 | 92 | 0 | ○ | 1800 | 3400 | X | 1602 | 9 | 18 | Δ | X |
| | 42 | 19 | 310 | 3 | 97 | 0 | X | 1600 | 3100 | X | 1313 | 8 | 12 | ○ | |
| | 43 | 20 | 300 | less than 1 | 99 | less than 1 | X | — | — | X | 1488 | 3 | 8 | ○ | |
| | 44 | 21 | 350 | 3 | 97 | 0 | X | 1500 | 3500 | X | 960 | 17 | exceeding 24 | ○ | |
| | 45 | 22 | 320 | 5 | 94 | 1 | ○ | 300 | 750 | ○ | 1448 | 6 | — | ○ | |
| | 46 | 1 | 350 | 11 | 20 | 69 | X | 1300 | 3200 | X | 955 | 16 | exceeding 24 | ○ | |

From Table 6, steel sheets of experiment No. 24 to 37 and 40 (examples), which satisfy the requisites defined in the invention, while these are ultrahigh-strength steel sheets of 980 MPa or more, are provided with excellent hydrogen embrittlement resistance and corrosion resistance after coating. Furthermore, the elongation that should be provided as the TRIP steel sheet as well was excellent and the weldability as well was excellent; accordingly, these are said steel sheets most preferable as reinforcing parts of automobiles that are exposed to an atmospheric corrosive environment.

Steel sheets of experiment No. 38 and 39 (examples) have sufficient mechanical strength, elongation and hydrogen embrittlement resistance. However, since the steel sheet of experiment No. 38 contains Mo much, the corrosion resistance after coating was deteriorated. The steel sheet of experiment No. 39, which does not contain B, resulted in deterioration of the corrosion resistance after coating.

On the other hand, steel sheets of experiment No. 41 to 46 (comparative examples), which do not satisfy the stipulation of the invention, respectively, have inconveniences below. A steel sheet of experiment No. 41 contains C excessively; accordingly, sufficient elongation, hydrogen embrittlement resistance and weldability are not obtained. The corrosion resistance after coating as well is deteriorated. A steel sheet of experiment No. 42 contains Mn less; accordingly, sufficient hydrogen embrittlement resistance is not obtained. The elongation as well is not sufficient.

A steel sheet of experiment No. 43 is an example where, by use of a steel grade (20) where an amount of Si is deficient, martensite steel that is an existing high strength steel was obtained. In the steel sheet, since the residual austenite is hardly present, the hydrogen embrittlement resistance was poor. Furthermore, the elongation demanded on a thin steel sheet was neither secured.

A steel sheet of experiment No. 44 is deficient in an amount of C; accordingly, sufficient mechanical strength is not obtained. Since a steel sheet of experiment No. 45 excessively contains Nb, the moldability was notably deteriorated and sufficient elongation was not obtained. Since a steel sheet of experiment No. 45 could not be bent, the hydrogen embrittlement resistance could not be investigated.

In experiment No. 46, a steel material that satisfies a component composition defined in the invention was used but recommended conditions were not used to produce (heating and holding temperature T1 during the annealing was lower than a $Ac_3$ point); accordingly, an obtained steel sheet became an existing TRIP steel sheet. As a result, the residual austenite did not satisfy the average axis ratio defined in the invention and the matrix phase is neither obtained in a two-phase texture of bainitic ferrite and martensite. Accordingly, sufficient mechanical strength could not be obtained.

In the next place, with a steel sheet of a steel grade (10) and a steel sheet of comparative example (existing high-tensile steel sheet having the mechanical strength in a class of 590 MPa), parts were prepared. Similarly to the first example, the crush resistance test and impact resistance test were conducted to investigate performance as molded products. Results thereof are shown in Table 7 and 8.

TABLE 7

| Steel Sheet Used: Steel Grade | TS (MPa) | EL (%) | Area ratio of Residual γ (%) | Evaluation Result of Test Piece: Maximum Load (kN) | Absorption Energy (kJ) |
|---|---|---|---|---|---|
| Mark 10 | 1461 | 12 | 8 | 14.1 | 0.68 |
| Comparative Steel | 612 | 22 | 0 | 5.7 | 0.34 |

TABLE 8

| Steel Sheet Used | | | | Evaluation Result of Test Piece |
|---|---|---|---|---|
| Steel Grade | TS (MPa) | EL (%) | Area ratio of Residual γ (%) | Absorption Energy (kJ) |
| Mark 10 | 1461 | 12 | 8 | 6.68 |
| Comparative Steel | 612 | 22 | 0 | 3.57 |

From Table 7, it is found that a part (test piece) prepared from a steel sheet (steel grade 10) of the invention shows a load higher than that when a comparative steel sheet low in the mechanical strength is used and is higher in the absorption energy as well, resulting in excellent crush resistance.

From Table 8, it is found that a component (test piece) prepared from a steel sheet (steel grade 10) of the invention has the absorption energy higher than that when a comparative steel sheet low in the mechanical strength is used and excellent impact resistance.

In what follows, third examples according to the second embodiment of the invention will be described.

Third Example

After steels (steel grades a to t) of which component compositions are shown in Table 9 were vacuum melted to form slabs, according to a procedure (hot rolling→cold rolling→continuous annealing) below, hot rolled steel sheets having a sheet thickness of 3.2 mm were obtained, followed by washing with acid to remove a surface scale, further followed by cold rolling to 1.2 mm, still further followed by continuously annealing as shown below, thereby, various kinds of steel sheets (experiment No. 47 to 67) were prepared.

<Hot Rolling Step>
Start Temperature: holding for 30 min at 1150 to 1250° C.
Finish Temperature: 850° C.
Cooling Speed: 40° C./s
Winding Temperature: 550° C.

<Cold Rolling Step>
Cold Rolling Rate: 50%

<Continuous Annealing Step>

Steel sheets of experiment No. 47 to 62 and 64 to 66, after the cold rolling, were held at a temperature in the range of a $Ac_3$ point (see Table 9) to the $Ac_3$ point+30° C. for 120 sec, followed by quenching (air cooling) at an average cooling speed of 20° C./s to a To° C. of Table 10, further followed by holding for 240 sec at the To° C., further followed by carrying out the gas and water cooling to room temperature. A steel sheet of experiment No. 63 that is made of martensite steel that is an existing high strength steel and uses a steel grade (q), after the cold rolling, was held at 880° C. for 30 min, followed by water-hardening, further followed by tempering at 300° C. for 1 hour. Furthermore, in order to investigate an influence that the producing conditions affect on a texture of a steel sheet, in a steel sheet of experiment No. 67, a steel grade (b) was used, the steel sheet after the cold rolling was held at a temperature of a $Ac_3$ point−50° C. for 120 sec, followed by quenching (air cooling) at an average cooling speed of 20° C./s to To° C. of Table 10, further followed by holding at the To° C. for 240 sec, still further followed by applying gas and water cooling to room temperature.

From each of thus obtained steel sheets, a JIS #5 test piece was sampled, followed by stretching at the processing rate of 3% simulating a process actually carried out, further followed by investigating and evaluating a metallographic texture of the respective samples before and after processing, the tensile strength (TS) and elongation (total elongation (EL)) before processing, the hydrogen embrittlement resistance properties (evaluation index of hydrogen embrittlement risk) after processing, the corrosion resistance and the delayed fracture resistance, respectively. Results thereof are shown in Table 10.

(Metallographic Texture)

An arbitrary measurement region (substantially 50 μm×50 μm, measurement distance: 0.1 μm) in a plane in parallel with a rolled plane at a position one fourth a sheet thickness of each of steel sheets was observed and photographed by use of a FE-SEM (trade name: XL30S-FEG, produced by Phillips Co., Ltd.) and the area ratios of bainitic ferrite (BF) and martensite (M) and the area ratio of the residual austenite (residual γ) were measured according to the method described above. In two arbitrarily selected viewing fields, similar measurements were carried out, followed by obtaining an average value. Furthermore, other texture (ferrite, pearlite and so on) was obtained by subtracting the area ratios of the textures (BF, M, residual austenite) from a total texture (100%).

Still furthermore, of grains of the residual γ after and before processing, the average axis ratio, average minor axis length and nearest-neighbor distance between grains was measured according to the methods mentioned above. In a third example, after processing, one that is 5 or more in the average axis ratio, 1 μm (1000 nm) or less in the average minor axis length and 1 μm (1000 nm) or less in the nearest-neighbor distance is evaluated as satisfying requisites of the invention (○) and one that is less than 5 in the average axis ratio, exceeding 1 μm (1000 nm) in the average minor axis length and exceeding 1 μm (1000 nm) in the nearest-neighbor distance is evaluated as not satisfying requisites of the invention (x).

(Tensile Strength, Elongation)

The tensile test was carried out with a JIS #5 test piece to measure the tensile strength (TS) and the elongation (EL). At the tensile test, a strain rate was set at 1 mm/sec. In the third example, among the steel sheets where the tensile strength measured according to the foregoing method is 980 MPa or more, one having the elongation of 10% or more was evaluated as "excellent in the elongation".

(Evaluation Index of Hydrogen Embrittlement Risk: Evaluation of Hydrogen Embrittlement Resistance)

By use of a planar test piece having a sheet thickness of 1.2 mm, a slow stretching rate tensile (SSRT) test was carried out at the stretching rate of $1\times10^{-4}$ mm/sec, and the evaluation index of hydrogen embrittlement risk (%) defined by a formula (1) below was obtained to evaluate the hydrogen embrittlement resistance.

$$\text{Evaluation index of hydrogen embrittlement risk } (\%)=100\times(1-E1/E0) \quad (1)$$

Here, E0 shows the elongation when a test piece that does not substantially contain hydrogen in the steel is ruptured and E1 shows the elongation at the rupture when hydrogen is intruded in the steel sheet (test piece) by a combined cycle test where a severe corrosion environment is assumed by setting a wetting time longer. In the combined cycle test, with a combination of showering 5% saline water for 8 hours and executing a constant temperature and constant humidity test at (temperature) 35° C. and (humidity) 60% RH for 16 hours as one cycle, 7 cycles were carried out. Since, when the evaluation index of hydrogen embrittlement risk exceeds 50%, the hydrogen embrittlement is likely to be caused in use, the evaluation index of hydrogen embrittlement risk was evaluated as excellent in the hydrogen embrittlement resistance when the index was 50% or more.

(Delayed Fracture Resistance: Evaluation of Hydrogen Embrittlement Resistance)

From each of the steel sheets, a strip specimen of 150 mm×30 mm was cut out, stretched to deform at the processing rate of 3%, followed by bending so that an R of a curved portion may be 15 mm, whereby, a bending test sample was prepared. The test piece for bending test, with stress of 1000 MPa applied thereto, was dipped in an aqueous solution of 5% HCl, and a time until crack is caused was measured to evaluate the hydrogen embrittlement resistance. When the time until the crack is caused is 24 hr or more, the hydrogen embrittlement resistance was judged excellent.

(Evaluation of Corrosion Resistance after Coating)

By simulating a usage environment, the corrosion resistance after coating as well was evaluated.

A planar test chip having a sheet thickness of 1.2 mm was cut out of each of the steel sheets as a test piece. The test piece, after zinc phosphate treatment, was subjected to commercially available electrodeposition coating to form a coated film having a film thickness of 25 μm. To a center of a parallel portion of the test piece to which the electrodeposition coating was applied, a bruise that reaches a base was generated by use of a cutter, and, a bruised test piece was supplied to the corrosion test. After a definite interval, an expanse of the corrosion from the artificial bruise due to the cutter (blister width) was measured. The blister width was normalized with the blister width of the test piece of experiment No. 47 set at (1) and ranked as shown below to evaluate the corrosion resistance after coating. When the blister width was more than 1.0 and 1.5 or less, the corrosion resistance after coating was evaluated a little deteriorated (Δ), and, when the blister width was 1.0 or less, the corrosion resistance after coating was evaluated excellent (○–⊙⊙⊙).

In table 10, when the blister width was 0.7 or less, the corrosion resistance after coating was expressed by (⊙⊙⊙), when the blister width was more than 0.7 and 0.75 or less, the corrosion resistance after coating was expressed by (⊙⊙○), when the blister width was more than 0.75 and 0.8 or less, the corrosion resistance after coating was expressed by (⊙⊙), when the blister width was more than 0.8 and 0.85 or less, the corrosion resistance after coating was expressed by (⊙○), when the blister width was more than 0.85 and 0.9 or less, the corrosion resistance after coating was expressed by (⊙Δ), when the blister width was more than 0.9 and 0.95 or less, the corrosion resistance after coating was expressed by (⊙), when the blister width was more than 0.95 and 1.0 or less, the corrosion resistance after coating was expressed by (○) and when the blister width was more than 1.0 and 1.05 or less, the corrosion resistance after coating was expressed by (Δ).

Furthermore, the zinc phosphate treatment was carried out after a pretreatment (degreasing, water washing, surface control) that is applied when a usual phosphate treatment is applied, and the electrodeposition coating was applied with SD5000 (trade name, produced by Nippon Paint Co., Ltd.) at 45° C. for 2 min. A coated amount (coated film) of a coating was controlled by a treatment time of the zinc phosphate treatment.

Still furthermore, the corrosion test was carried out in such a manner that, to a test piece to which the electrodeposition coating was applied, an aqueous solution of NaCl was showered at 35° C., followed by drying at 60° C., further followed by carrying out, with an operation of leaving under an atmosphere of a temperature of 50° C. and the relative humidity of 95% as 1 cycle (8 hours), 3 cycles a day for 30 days.

TABLE 9

| Steel Grade | Component Composition (% by weight) | | | | | | | | | | | | | | | $Ac_3$ | Bs | Ms |
|---|---|---|---|---|---|---|---|---|---|---|---|---|---|---|---|---|---|---|
| Mark | C | Si | Mn | P | S | Al | Cr | Cu | Ni | Ti | V | Nb | Mo | B | Others | (° C.) | (° C.) | (° C.) |
| a | 0.3 | 1.54 | 2.32 | 0.011 | 0.002 | 0.031 | 0.006 | | | | | | | | | 820.8 | 547.9 | 345.1 |
| b | 0.4 | 1.48 | 2.01 | 0.012 | 0.002 | 0.033 | 0.006 | | | | | 0.05 | 0.05 | 0.0009 | | 810.6 | 536.5 | 303.9 |
| c | 0.27 | 1.49 | 2.48 | 0.011 | 0.002 | 0.031 | 0.008 | | | | | 0.05 | 0.02 | 0.0009 | | 817.4 | 531.7 | 350.6 |
| d | 0.46 | 1.5 | 2.5 | 0.011 | 0.002 | 0.03 | 0.007 | | | | | 0.05 | | 0.0002 | | 784 | 480.3 | 260.3 |
| e | 0.4 | 1.51 | 2.48 | 0.011 | 0.002 | 0.033 | 0.005 | 0.2 | 0.05 | 0.05 | | 0.05 | | 0.0002 | | 810.8 | 496.6 | 288.6 |
| f | 0.35 | 1.5 | 2.5 | 0.012 | 0.002 | 0.033 | 0.006 | 0.3 | 0.3 | 0.05 | | 0.05 | | 0.0002 | Ca: 0.004<br>Mg: 0.006 | 812.9 | 499 | 307.4 |
| g | 0.45 | 1.53 | 1.89 | 0.011 | 0.002 | 0.032 | 0.3 | 0.32 | 0.2 | 0.04 | | 0.05 | 0.4 | | | 821.9 | 476.8 | 268.4 |
| h | 0.44 | 1.5 | 1.61 | 0.012 | 0.002 | 0.035 | 0.6 | | | | 0.05 | 0.05 | 0.2 | | Ca: 0.005<br>Mg: 0.003 | 821.4 | 507.7 | 284.9 |
| i | 0.5 | 1.53 | 1.77 | 0.012 | 0.002 | 0.033 | 0.4 | 0.22 | 0.1 | 0.02 | | 0.03 | 0.2 | | | 807.3 | 487.4 | 252.9 |
| j | 0.38 | 1.81 | 2.34 | 0.01 | 0.002 | 0.031 | 0.7 | 0.31 | 0.05 | | | 0.05 | 0.2 | | | 806.6 | 449.4 | 286.7 |
| k | 0.32 | 1.54 | 1.93 | 0.012 | 0.002 | 0.033 | 0.06 | | | | | 0.02 | 0.05 | 0.002 | Zr: 0.02<br>REM: 0.001 | 828.6 | 561.6 | 343.6 |
| l | 0.28 | 1.48 | 2.56 | 0.011 | 0.002 | 0.031 | 0.01 | | | | | 0.05 | 0.02 | | | 812.6 | 521.6 | 343.2 |
| m | 0.55 | 1.46 | 1.51 | 0.012 | 0.002 | 0.032 | 0.03 | | | | | 0.02 | | 0.002 | W: 0.015 | 800.3 | 543.5 | 250 |
| n | 0.29 | 1.53 | 2.54 | 0.011 | 0.002 | 0.033 | 0.04 | | | | | 0.05 | | | | 813.3 | 520.3 | 339 |
| o | 0.19 | 1.51 | 1.52 | 0.011 | 0.005 | 0.031 | 0.1 | | | | | 0.02 | 0.1 | | | 865.6 | 626.6 | 417 |
| p | 0.45 | 2.25 | 0.82 | 0.01 | 0.003 | 0.031 | 0.2 | | | | | 0.05 | 0.2 | | | 873.3 | 604.1 | 313 |
| q | 0.28 | 0.2 | 2.58 | 0.012 | 0.002 | 0.029 | 0.4 | | | | | 0.05 | 0.4 | | | 762.3 | 461 | 327.9 |
| r | 0.7 | 1.51 | 2.54 | 0.01 | 0.003 | 0.03 | | | | | | 0.04 | | 0.0002 | | 750.5 | 412.4 | 145.4 |
| s | 0.33 | 1.55 | 3.62 | 0.011 | 0.004 | 0.033 | 0.7 | | | | | 0.04 | 0.1 | | | 770.4 | 357.8 | 271.1 |
| t | 0.51 | 1.46 | 2.51 | 0.01 | 0.002 | 0.035 | 2.3 | | | | | 0.05 | 0.1 | | | 753.8 | 297.1 | 195.2 |

(Note)

A balance is made of Fe and inevitable impurities

TABLE 10

| | | | | Before Processing | | | | | | | |
|---|---|---|---|---|---|---|---|---|---|---|---|
| | | | | | | | Dispersion Form of Residual γ | | | | |
| | | | | Area ratio (%) | | | Average | Average Minor Axis | | | |
| | Experiment No. | Steel Grade Mark | To (° C.) | Residual γ | BF + M | Other | Axis Ratio | Length (nm) | Nearest-neighbor Distance (nm) | TS (Mpa) | EL (%) |
| Examples | 47 | a | 380 | 10 | 90 | 0 | 10 | 250 | 550 | 1035 | 15 |
| | 48 | b | 380 | 13 | 87 | 0 | 10 | 220 | 484 | 1480 | 14 |
| | 49 | c | 380 | 11 | 89 | 0 | 15 | 210 | 462 | 1260 | 16 |
| | 50 | d | 350 | 12 | 88 | 0 | 20 | 130 | 260 | 1590 | 12 |
| | 51 | e | 350 | 13 | 87 | 0 | 18 | 150 | 300 | 1430 | 14 |
| | 52 | f | 350 | 11 | 88 | 1 | 22 | 120 | 240 | 1379 | 14 |
| | 53 | g | 350 | 12 | 88 | 0 | 23 | 110 | 220 | 1480 | 13 |
| | 54 | h | 320 | 11 | 88 | 1 | 33 | 90 | 162 | 1526 | 12 |
| | 55 | i | 320 | 13 | 87 | 0 | 50 | 80 | 144 | 1571 | 10 |
| | 56 | j | 350 | 13 | 86 | 1 | 18 | 130 | 260 | 1486 | 12 |
| | 57 | k | 380 | 12 | 88 | 0 | 11 | 230 | 506 | 994 | 18 |
| | 58 | l | 320 | 13 | 87 | 0 | 40 | 90 | 162 | 1192 | 16 |
| | 59 | m | 350 | 11 | 88 | 1 | 20 | 120 | 240 | 1378 | 15 |
| | 60 | n | 320 | 13 | 86 | 1 | 35 | 80 | 144 | 1250 | 15 |
| Comparative Example | 61 | o | 430 | 6 | 92 | 2 | 8 | 300 | 750 | 1410 | 11 |
| | 62 | p | 350 | 2 | 95 | 3 | 1.5 | 1400 | 2800 | 960 | 6 |
| | 63 | q | 300 | less than 1 | 99 | 1 | — | — | — | 1530 | 6 |
| | 64 | r | 350 | 12 | 88 | 0 | 3 | 1600 | 3200 | 1430 | 9 |
| | 65 | s | 320 | 10 | 88 | 2 | 40 | 90 | 162 | 1246 | 5 |
| | 66 | t | 320 | 11 | 87 | 2 | 2.5 | 700 | 1400 | 1120 | 13 |
| | 67 | b | 350 | 8 | 51 | 41 | 3 | 1500 | 3000 | 943 | 19 |

| | | | | After Processing | | | | | | | | | |
|---|---|---|---|---|---|---|---|---|---|---|---|---|---|
| | | | | | | | Dispersion Form of Residual γ | | | Evaluation Index of | | | |
| | | | | Area ratio (%) | | | | Average Minor | Nearest- | | Hydrogen Em- | Delayed | Corrosion |
| | Experiment No. | Steel Grade Mark | To (° C.) | Residual γ | BF + M | Other | Average Axis Ratio | Axis Length (nm) | neigbor Distance (nm) | Evaluation | brittlement Risk (%) | Fracture Resistance (hour) | Resistance after Coating |
| Examples | 47 | a | 380 | 4 | 95 | 1 | 10 | 240 | 552 | ○ | 45 | exceeding 24 | Δ |
| | 48 | b | 380 | 6 | 94 | 0 | 10 | 210 | 483 | ○ | 33 | exceeding 24 | Δ |
| | 49 | c | 380 | 4 | 96 | 0 | 15 | 200 | 460 | ○ | 33 | exceeding 24 | ○ |
| | 50 | d | 350 | 6 | 94 | 0 | 20 | 110 | 231 | ○ | 31 | exceeding 24 | ⊙○ |
| | 51 | e | 350 | 5 | 95 | 0 | 18 | 140 | 294 | ○ | 27 | exceeding 24 | ⊙⊙○ |
| | 52 | f | 350 | 4 | 96 | 0 | 22 | 110 | 231 | ○ | 24 | exceeding 24 | ⊙⊙⊙ |
| | 53 | g | 350 | 6 | 94 | 0 | 21 | 100 | 210 | ○ | 33 | exceeding 24 | ⊙ |
| | 54 | h | 320 | 6 | 93 | 1 | 34 | 90 | 171 | ○ | 36 | exceeding 24 | Δ |
| | 55 | i | 320 | 7 | 92 | 1 | 45 | 70 | 133 | ○ | 29 | exceeding 24 | ○ |
| | 56 | j | 350 | 5 | 93 | 2 | 16 | 110 | 231 | ○ | 24 | exceeding 24 | ○ |
| | 57 | k | 380 | 6 | 94 | 0 | 11 | 220 | 506 | ○ | 20 | exceeding 24 | Δ |
| | 58 | l | 320 | 7 | 93 | 0 | 40 | 80 | 152 | ○ | 24 | exceeding 24 | Δ |
| | 59 | m | 350 | 5 | 94 | 1 | 20 | 100 | 210 | ○ | 27 | exceeding 24 | ⊙ |
| | 60 | n | 320 | 6 | 94 | 0 | 35 | 70 | 133 | ○ | 24 | exceeding 24 | ⊙○ |
| Comparative Examples | 61 | o | 430 | less than 1 | 99 | less than 1 | 4 | 280 | 700 | X | 78 | 8 | Δ |
| | 62 | p | 350 | less than 1 | 95 | 5 | — | — | — | X | 60 | exceeding 24 | X |
| | 63 | q | 300 | less than 1 | 99 | less than 1 | — | — | — | X | 70 | 6 | X |
| | 64 | r | 350 | 2 | 95 | 3 | 4 | 1500 | 1400 | X | 75 | 2 | X |
| | 65 | s | 320 | 2 | 95 | 3 | 3 | 80 | 1200 | X | 80 | 12 | X |
| | 66 | t | 320 | 3 | 96 | 1 | 3 | 1400 | 1200 | X | 65 | 16 | Δ |
| | 67 | b | 350 | 2 | 56 | 42 | 2.5 | 1300 | 1200 | X | 65 | exceeding 24 | Δ |

From Tables 9 and 10, it is found that steel sheets of experiment No. 47 to 60(examples), which satisfy requisites defined in the invention, are ultrahigh-strength steel sheets of 980 MPa or more and combine, even after the processing, excellent hydrogen embrittlement resistance and corrosion resistance after coating. Furthermore, since the elongation that the TRIP steel sheet has to satisfy as well is excellent, the steel sheets may be mentioned most preferable as reinforcing parts of automobiles that are exposed to an atmospheric corrosion environment.

On the other hand, steel sheets of experiment No. 61 to 67 (comparative examples), which do not satisfy the stipulation of the invention, have inconveniences shown below. A steel sheet of experiment No. 61 is deficient in an amount of C and hardly contains residual γ(residual austenite) after stretching of 3%; as a result, the hydrogen embrittlement resistance is not obtained. Accordingly, it may be mentioned poor in the workability. A steel sheet of experiment No. 62, because an amount of Mn is deficient therein, hardly contains the residual γ; accordingly, a dispersion form of the residual γ is not satisfied. As a result, an evaluation index of hydrogen embrittlement risk is high and the hydrogen embrittlement resistance is not obtained. Accordingly, it may be mentioned poor in the workability. Furthermore, since hardenability is deteriorated, sufficient mechanical strength and elongation are not obtained. Still furthermore, the corrosion resistance after coating is deteriorated.

Experiment No. 63 is an example where martensite steel that is existing high strength steel is obtained with a steel grade that is deficient in an amount of Si. However, the residual γ hardly exists and the dispersion form of the residual γ is neither satisfied. Accordingly, sufficient elongation and hydrogen embrittlement resistance are not obtained. As a result, it can be mentioned poor in the workability. Furthermore, the corrosion resistance after coating is also deteriorated. A steel sheet of experiment No. 64 is excessive in an amount of C and does not contain Cr; accordingly, the dispersion form of the residual γ is not satisfied and the hydrogen embrittlement resistance is poor. Accordingly, it can be mentioned poor in the workability. Furthermore, the corrosion resistance after coating is also poor. Although a steel sheet of experiment No. 65 is excessive in an amount of Mn, predetermined residual austenite is obtained. However, since the stability of the residual austenite is low, the residual austenite does not stably exist after the processing. As a result, the hydrogen embrittlement resistance is not obtained. Accordingly, it can be mentioned poor in the workability. Furthermore, sufficient elongation is not obtained. Still furthermore, the corrosion resistance after coating is deteriorated.

Since a steel sheet of experiment No. 66 is excessive in an amount of Cr and does not satisfy the dispersion mode of the residual γ, coarse carbide is precipitated to deteriorate the workability and the hydrogen embrittlement resistance is not obtained. Accordingly, it is mentioned poor in the workability. A steel sheet of experiment No. 67, although a steel grade (b) that satisfies the component range defined by the invention is used therein, was not produced according to a recommended producing condition (the heating and holding temperature T1 during the annealing is a $Ac_3$ point−50° C.); accordingly, an obtained steel sheet resulted in an existing TRIP steel sheet. That is, the residual austenite did not satisfy the dispersion form defined by the invention to be an aggregate and a matrix phase neither formed a two-phase texture of bainitic ferrite and martensite. As a result, sufficient mechanical strength was not obtained. Furthermore, the evaluation index of hydrogen embrittlement risk was high and the hydrogen embrittlement resistance was not obtained. Accordingly, it can be mentioned poor in the workability.

In the next place, parts were molded from a steel sheet of a steel grade (e) shown in Table 9 and a comparative steel sheet (existing high-tensile steel sheet having the mechanical strength in a class of 590 MPa), followed by conducting the crush resistance test and impact resistance test as shown below to investigate performance as a molded product.

(Crush Resistance Test)

With the steel sheets of steel grades (e) shown in Table 9 and a comparative steel sheet, a part (a test piece, a hat channel component) 1 shown in FIG. 5 was prepared, followed by carrying out the crush resistance test. To a spot welding position 2 of a part shown in FIG. 5, from an electrode having a tip diameter of 6 mm, a current lower by 0.5 kA than a dust generation current was flowed to carry out the spot welding at a pitch of 35 mm as shown in FIG. 5. In the next place, as shown in FIG. 6, from an upper portion of a central portion in a longer direction of the part 1, a metal mold 3 was pressed down to obtain the maximum load. Furthermore, from an area of a load-displacement line graph, absorption energy was obtained. Results thereof are shown in Table 11.

TABLE 11

| Steel Sheet Used | | | | Evaluation Result of Test Piece | |
|---|---|---|---|---|---|
| Steel Grade | TS (MPa) | EL (%) | Area ratio of Residual γ (%) | Maximum Load (kN) | Absorption Energy (kJ) |
| Mark e | 1430 | 14 | 13 | 14.1 | 0.72 |
| Comparative Steel | 611 | 22 | 0 | 5.7 | 0.33 |

From Table 11, it is found that parts (test pieces) prepared from steel sheets (steel grades e) of the invention show loads higher than that when a comparative steel sheet low in the mechanical strength is used and are higher in the absorption energy as well, that is, are excellent in the crush resistance.

(Impact Resistance Test)

With the steel sheets of steel grades (e) shown in Table 9 and a comparative steel sheet, a part (a test piece, a hat channel component) 4 such as shown in FIG. 7 was prepared, followed by carrying out the impact resistance test. FIG. 8 shows an A-A sectional view of a part 4 in the FIG. 7. In the impact resistance test, after spot welding was carried out to spot welding positions 5 of a part 4 similarly to the case of the crush resistance test, the part 4 was set on a base 7 as shown schematically in FIG. 9, from above the part 4, a weight (110 kg) 6 was fallen from a height of 11 m and, thereby, absorption energy until the part 4 was deformed by 40 mm (contraction in a height direction) was obtained. Results thereof are shown in Table 12.

TABLE 12

| Steel Sheet Used | | | | Evaluation Result of Test Piece |
|---|---|---|---|---|
| Steel Grade | TS (MPa) | EL (%) | Area ratio of Residual γ (%) | Absorption Energy (kJ) |
| Mark e | 1430 | 14 | 13 | 6.67 |
| Comparative Steel | 611 | 22 | 0 | 3.56 |

From Table 12, it is found that parts (test pieces) prepared from the steel sheets (steel grade e) of the invention have the absorption energy higher than that when an existing steel sheet lower in the mechanical strength is used, that is, are excellent in the impact resistance.

The invention was detailed with reference to specified modes. However, it is obvious to those skilled in the art that various modifications and corrections may be applied without deviating from the spirit and range of the invention.

The invention is based on Japanese Patent Application No. 2005-379188 filed on Dec. 28, 2005, Japanese Patent Application No. 2006-310359 filed on Nov. 16, 2006 and Japanese Patent Application No. 2006-310458 filed on Nov. 16, 2006 and an entirety thereof is incorporated herein by reference.

Furthermore, all references cited here are incorporated herein as a whole by reference.

INDUSTRIAL APPLICABILITY

According to the invention, a ultrahigh-strength TRIP thin steel sheet having the mechanical strength of 980 MPa or more, which is not damaged in the ductility (elongation), does not generate coarse carbide in the proximity of a grain boundary even when Cr is added, and drastically improves the hydrogen embrittlement resistance, is provided. Furthermore, an ultrahigh-strength TRIP thin steel sheet having the mechanical strength of 980 MPa or more, which does not generate coarse carbide in the proximity of a grain boundary even when Cr is added and drastically improves the workability and hydrogen embrittlement resistance, is provided.

The invention claimed is:

1. An ultrahigh-strength thin steel sheet having excellent corrosion resistance and hydrogen embrittlement resistance, consisting essentially of:

0.10 to 0.25 mass % of C;
1.0 to 3.0 mass % of Si;
1.0 to 3.5 mass % of Mn;
0.15 mass % or less of P;
0.02 mass % or less of S;
1.5 mass % or less of Al;
0.003 to 2.0 mass % of Cr;
0.003 to 0.5 mass % of Cu;
0.003 to 1.0 mass % of Ni;
0.003 to 1.0 mass % of Ti;
0.1 mass % or less of Nb;
0.0005 to 0.01 mass % of B;
0.005 mass % or less of Mo; and
a balance of iron and inevitable impurities;
wherein:
the steel sheet contains 1% or more of residual austenite in terms of an area ratio with respect to a total texture of the steel sheet; and
grains of the residual austenite have an average axis ratio (major axis/minor axis) of 5 or more;
the grains of the residual austenite have an average minor axis length of 1 μm or less; and
the grains of the residual austenite have a nearest-neighbor distance between grains of 1 μm or less.

2. The ultrahigh-strength thin steel sheet of claim 1, wherein the steel sheet contains, in terms of an area ratio with respect to a total texture of the steel sheet, bainitic ferrite and martensite in a total amount of 80% or more and ferrite and pearlite in a total amount of 0 to 9%.

3. The ultrahigh-strength thin steel sheet of claim 2, further including:

0.003 to 1.0 mass % of V; and
0.0005 to 0.005 mass % of Ca.

4. The ultrahigh-strength thin steel sheet of claim 3, further including less than 0.005 mass % of Mo.

5. The ultrahigh-strength thin steel sheet of claim 4, further including at least one member selected from the group consisting of 0.0005 to 0.005 mass % of Ca, 0.0005 to 0.01 mass % of Mg and 0.0005 to 0.01 mass % of REM.

6. The ultrahigh-strength thin steel sheet of claim 3, further including at least one member selected from the group consisting of 0.0005 to 0.005 mass % of Ca, 0.0005 to 0.01 mass % of Mg and 0.0005 to 0.01 mass % of REM.

7. The ultrahigh-strength thin steel sheet of claim 2, further including less than 0.005 mass % of Mo.

8. The ultrahigh-strength thin steel sheet of claim 7, further including at least one member selected from the group consisting of 0.0005 to 0.005 mass % of Ca, 0.0005 to 0.01 mass % of Mg and 0.0005 to 0.01 mass % of REM.

9. The ultrahigh-strength thin steel sheet of claim 2, further including at least one member selected from the group consisting of 0.0005 to 0.005 mass % of Ca, 0.0005 to 0.01 mass % of Mg and 0.0005 to 0.01 mass % of REM.

10. The ultrahigh-strength thin steel sheet of claim 1, further including:

0.003 to 1.0 mass % of V; and
0.0005 to 0.005 mass % of Ca.

11. The ultrahigh-strength thin steel sheet of claim 10, further including less than 0.005 mass % of Mo.

12. The ultrahigh-strength thin steel sheet of claim 11, further including at least one member selected from the group consisting of 0.0005 to 0.005 mass % of Ca, 0.0005 to 0.01 mass % of Mg and 0.0005 to 0.01 mass % of REM.

13. The ultrahigh-strength thin steel sheet of claim 10, further including at least one member selected from the group consisting of 0.0005 to 0.005 mass % of Ca, 0.0005 to 0.01 mass % of Mg and 0.0005 to 0.01 mass % of REM.

14. The ultrahigh-strength thin steel sheet of claim 1, further including less than 0.005 mass % of Mo.

15. The ultrahigh-strength thin steel sheet of claim 14, further including at least one member selected from the group consisting of 0.0005 to 0.005 mass % of Ca, 0.0005 to 0.01 mass % of Mg and 0.0005 to 0.01 mass % of REM.

16. The ultrahigh-strength thin steel sheet of claim 1, further including at least one member selected from the group consisting of 0.0005 to 0.005 mass % of Ca, 0.0005 to 0.01 mass % of Mg and 0.0005 to 0.01 mass % of REM.

17. An ultrahigh-strength thin steel sheet having excellent corrosion resistance and hydrogen embrittlement resistance, consisting essentially of:

more than 0.25 but not more than 0.60 mass % of C;
1.0 to 3.0 mass % of Si;
1.0 to 3.5 mass % of Mn;
0.15 mass % or less of P;
0.02 mass % or less of S;
1.5 mass % or less of Al;
0.003 to 2.0 mass % of Cr
0.003 to 0.5 mass % of Cu;
0.003 to 1.0 mass % of Ni;
0.003 to 1.0 mass % of Ti;
0.005 to 0.1 mass % of Nb;
0.0002 to 0.01 mass % of B;
0.005 mass % or less of Mo; and
a balance of iron and inevitable impurities;
wherein:
a metallographic texture of the steel sheet after tensile processing at a working rate of 3% contains 1% or more of residual austenite in terms of an area ratio with respect to the metallographic texture;
in the metallographic texture, grains of the residual austenite have an average axis ratio (major axis/minor axis) of 5 or more;
the grains of the residual austenite have an average minor axis length of 1 μm or less; and
the grains of the residual austenite have a nearest-neighbor distance between grains of 1 μm or less.

18. The ultrahigh-strength thin steel sheet of claim 17, wherein the metallographic texture of the steel sheet after tensile processing at a working rate of 3% contains, in terms of an area ratio with respect to the metallographic texture, bainitic ferrite and martensite in a total amount of 80% or more and ferrite and pearlite in a total amount of 0 to 9%.

19. The ultrahigh-strength thin steel sheet of claim 18, further including:

0.0005 to 0.005 mass % of Ca; and
0.0005 to 0.01 mass % of Mg.

20. The ultrahigh-strength thin steel sheet of claim 17, further including:

0.0005 to 0.005 mass % of Ca; and 0.0005 to 0.01 mass % of Mg.

21. The ultrahigh-strength thin steel sheet of claim 17, further including less than 0.005 mass % of Mo.

22. An ultrahigh-strength thin steel sheet having excellent corrosion resistance and hydrogen embrittlement resistance, consisting of:

0.10 to 0.25 mass % of C;

1.0 to 3.0 mass % of Si;

1.0 to 3.5 mass % of Mn;

0.15 mass % or less of P;

0.02 mass % or less of S;

1.5 mass % or less of Al;

0.003 to 2.0 mass % of Cr;

0.003 to 0.5 mass % of Cu;

0.003 to 1.0 mass % of Ni;

0.003 to 1.0 mass % of Ti;

0.1 mass % or less of Nb;

0.0005 to 0.01 mass % of B; and a balance of iron and inevitable impurities;

wherein:

the steel sheet contains 1% or more of residual austenite in terms of an area ratio with respect to a total texture of the steel sheet; and grains of the residual austenite have an average axis ratio (major axis/minor axis) of 5 or more;

the grains of the residual austenite have an average minor axis length of 1 μm or less; and the grains of the residual austenite have a nearest-neighbor distance between grains of 1 μm or less.

23. An ultrahigh-strength thin steel sheet having excellent corrosion resistance and hydrogen embrittlement resistance, consisting of:

more than 0.25 but not more than 0.60 mass % of C;

1.0 to 3.0 mass % of Si;

1.0 to 3.5 mass % of Mn;

0.15 mass % or less of P;

0.02 mass % or less of S;

1.5 mass % or less of Al;

0.003 to 2.0 mass % of Cr 0.003 to 0.5 mass % of Cu;

0.003 to 1.0 mass % of Ni;

0.003 to 1.0 mass % of Ti;

0.005 to 0.1 mass % of Nb;

0.0002 to 0.01 mass % of B; and a balance of iron and inevitable impurities;

wherein:

a metallographic texture of the steel sheet after tensile processing at a working rate of 3% contains 1% or more of residual austenite in terms of an area ratio with respect to the metallographic texture;

in the metallographic texture, grains of the residual austenite have an average axis ratio (major axis/minor axis) of 5 or more;

the grains of the residual austenite have an average minor axis length of 1 μm or less; and the grains of the residual austenite have a nearest-neighbor distance between grains of 1 μm or less.

* * * * *